US011148899B2

(12) United States Patent
Morikawa

(10) Patent No.: US 11,148,899 B2
(45) Date of Patent: Oct. 19, 2021

(54) IMAGE READING APPARATUS

(71) Applicant: PFU Limited, Ishikawa (JP)

(72) Inventor: Shuichi Morikawa, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 233 days.

(21) Appl. No.: 16/393,750

(22) Filed: Apr. 24, 2019

(65) Prior Publication Data

US 2019/0248613 A1 Aug. 15, 2019

Related U.S. Application Data

(63) Continuation of application No. PCT/JP2016/087851, filed on Dec. 19, 2016.

(51) Int. Cl.
*B65H 29/60* (2006.01)
*B65H 29/12* (2006.01)
*B65H 5/36* (2006.01)

(52) U.S. Cl.
CPC ..... *B65H 29/60* (2013.01); *B65H 5/36* (2013.01); *B65H 29/125* (2013.01); *B65H 2404/63* (2013.01)

(58) Field of Classification Search
CPC ..... B65H 5/36; B65H 29/58; B65H 29/60; B65H 2301/544; B65H 2404/63; B65H 2404/632; B65H 2404/65; B65H 2404/74; B65H 2404/741; B65H 2404/7414; B65H 2511/13; B65H 2801/39
See application file for complete search history.

(56) References Cited

U.S. PATENT DOCUMENTS 4,506,882 A * 3/1985 Ito ..... B65H 29/60 271/303
5,083,769 A * 1/1992 Young, Jr. ..... B65H 39/10 271/280

(Continued)

FOREIGN PATENT DOCUMENTS

JP 58-94068 U 6/1983
JP 60-072441 U 5/1985

(Continued)

OTHER PUBLICATIONS

International Search Report issued in corresponding International Patent Application No. PCT/JP2016/087851, dated Mar. 7, 2017, with English Translation.

*Primary Examiner* — Prasad V Gokhale
(74) *Attorney, Agent, or Firm* — McDermott Will & Emery LLP

(57) ABSTRACT

An image reading apparatus includes a reading device that reads an image on a document that is conveyed through a first conveying path, a switching guide that is supported so as to be able to rotate about a rotation axis, guides the document to a second conveying path by being disposed at a first position, and guides the document to a third conveying path by being disposed at a second position; and a roller that conveys the document to one of the second conveying path and the third conveying path after the reading device reads the document, wherein the second conveying path is arranged above a plane that is formed along the first conveying path, and the rotation axis is arranged below the plane and on an upstream side of a vertical plane that comes in contact with an edge of a downstream side of the roller.

10 Claims, 11 Drawing Sheets

(56) References Cited

U.S. PATENT DOCUMENTS

| | | | | |
|---|---|---|---|---|
| 2003/0175060 | A1* | 9/2003 | Suzuki | B65H 29/58<br>399/401 |
| 2018/0304275 | A1* | 10/2018 | Yoda | B02C 25/00 |

FOREIGN PATENT DOCUMENTS

| | | | |
|---|---|---|---|
| JP | H06-305622 | A | 11/1994 |
| JP | 2006-103913 | A | 4/2006 |
| JP | 2007-049300 | A | 2/2007 |
| JP | 2012-206841 | A | 10/2012 |
| JP | 2013-052929 | A | 3/2013 |

* cited by examiner

IMAGE READING APPARATUS

CROSS-REFERENCE TO RELATED APPLICATION

This application is a continuation of International Application No. PCT/JP2016/087851, filed on Dec. 19, 2016, the entire contents of which are incorporated herein by reference.

FIELD

The embodiments discussed herein are related to an image reading apparatus.

BACKGROUND

An image reading apparatus that conveys a document using a U-turn path has been known. A setting space of the image reading apparatus as mentioned above can be reduced by providing a platen, on which a document to be fed is placed, on the rear side of the apparatus and providing a stacker, on which the discharged document is placed, on an upper front part of the platen. The image reading apparatus as described above further includes a straight path for conveying a document without bending the document, and is able to switch between the paths for conveying the document such that the document is appropriately conveyed (see Japanese Laid-open Patent Publication No. 2013-52929, Japanese Laid-open Patent Publication No. 2007-49300, and Japanese Laid-open Patent Publication No. 2012-206841).

However, in the image reading apparatus as described above, there is a problem in that the size of the apparatus increases and the setting space of the apparatus increases depending on movement of a guide that switches between the conveying paths for conveying the document.

SUMMARY

According to an aspect of an embodiment, an image reading apparatus includes a reading device that reads an image on a document that is conveyed through a first conveying path, a switching guide that is supported so as to be able to rotate about a rotation axis, guides the document to a second conveying path by being disposed at a first position, and guides the document to a third conveying path by being disposed at a second position; and a roller that conveys the document to one of the second conveying path and the third conveying path after the reading device reads the document, wherein the second conveying path is arranged above a plane that is formed along the first conveying path, and the rotation axis is arranged below the plane and on an upstream side of a vertical plane that comes in contact with an edge of a downstream side of the roller.

The object and advantages of the disclosure will be realized and attained by means of the elements and combinations particularly pointed out in the claims.

It is to be understood that both the foregoing general description and the following detailed description are exemplary and explanatory and are not restrictive of the disclosure.

DESCRIPTION OF EMBODIMENTS

Preferred embodiments of the disclosure will be explained with reference to accompanying drawings. Exemplary embodiments of an image reading apparatus disclosed in the present application will be described below with reference to the drawings. The present disclosure is not limited by the description below. Further, in the following description, the same components are denoted by the same reference signs, and the same explanation will be omitted.

First Embodiment

Figure 1:
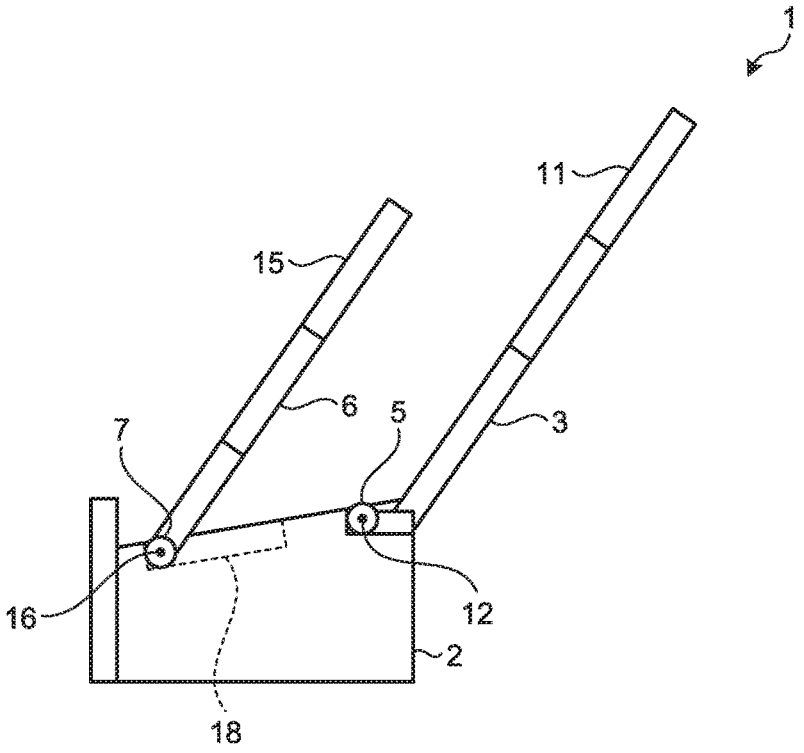
FIG. 1 is a side view illustrating an image reading apparatus according to a first embodiment.

FIG. 1 is a side view illustrating an image reading apparatus 1 according to a first embodiment. As illustrated in FIG. 1, the image reading apparatus 1 includes a body 2, a shooter 3, a shooter supporting unit 5, a stacker 6, and a stacker supporting unit 7. The body 2 is in the form of a box and mounted on a setting surface at which the image reading apparatus 1 is set. The shooter 3 is in the form of a plate and includes a substantially flat shooter mounting surface 11. The shooter 3 is arranged on an upper rear part of the body 2 (on the right side in FIG. 1) such that the shooter mounting surface 11 is oriented obliquely upward and an angle between the shooter mounting surface 11 and the setting surface of the image reading apparatus 1 becomes equal to 55 degrees when the setting surface of the image reading apparatus 1 is horizontally disposed. The shooter supporting unit 5 supports the shooter 3 such that the shooter 3 can rotate about a rotation axis 12 with respect to the body 2. The rotation axis 12 parallel to the setting surface of the image reading apparatus 1 and is also parallel to the shooter mounting surface 11. Further, the shooter supporting unit 5 prevents the shooter 3 from rotating such that the angle between the shooter mounting surface 11 and the setting surface of the image reading apparatus 1 is not reduced to below 55 degrees. In other words, the shooter supporting unit 5 supports the shooter 3 such that the shooter 3 does not rotate clockwise about the rotation axis 12 due to gravity from the state as illustrated in FIG. 1.

The stacker 6 is in the form of a plate and includes a substantially flat stacker mounting surface 15. The stacker 6 is arranged on an upper front part of the body 2 (on the left side in FIG. 1) such that the stacker mounting surface 15 becomes substantially parallel to the shooter mounting surface 11. In other words, the stacker 6 is arranged such that the stacker mounting surface 15 is oriented obliquely upward and an angle between the stacker mounting surface 15 and the setting surface of the image reading apparatus 1 becomes equal to 55 degrees. With this arrangement, the stacker 6 covers a part of the shooter mounting surface 11. The stacker supporting unit 7 supports the stacker 6 such that the stacker 6 can rotate about a rotation axis 16 with respect to the body 2. The rotation axis 16 is parallel to the rotation axis 12, that is, parallel to the setting surface of the image reading apparatus 1, and is also parallel to the stacker mounting surface 15. Further, the stacker supporting unit 7 prevents the stacker 6 from rotating such that the angle between the stacker mounting surface 15 and the setting surface of the image reading apparatus 1 is not reduced to below 55 degrees. In other words, the stacker supporting unit 7 supports the stacker 6 such that the stacker 6 does not rotate counterclockwise about the rotation axis 16 from the state as illustrated in FIG. 1.

The image reading apparatus 1 includes a stacker storage region 18. The stacker storage region 18 is formed between the shooter 3 and the stacker 6 in an upper part of the body 2. In other words, the stacker storage region 18 is arranged on the rear side relative to the rotation axis 16 of the stacker 6 in the upper part of the body 2, and arranged on the front side relative to the rotation axis 12 of the shooter 3 in the upper part of the body 2.

Figure 2:
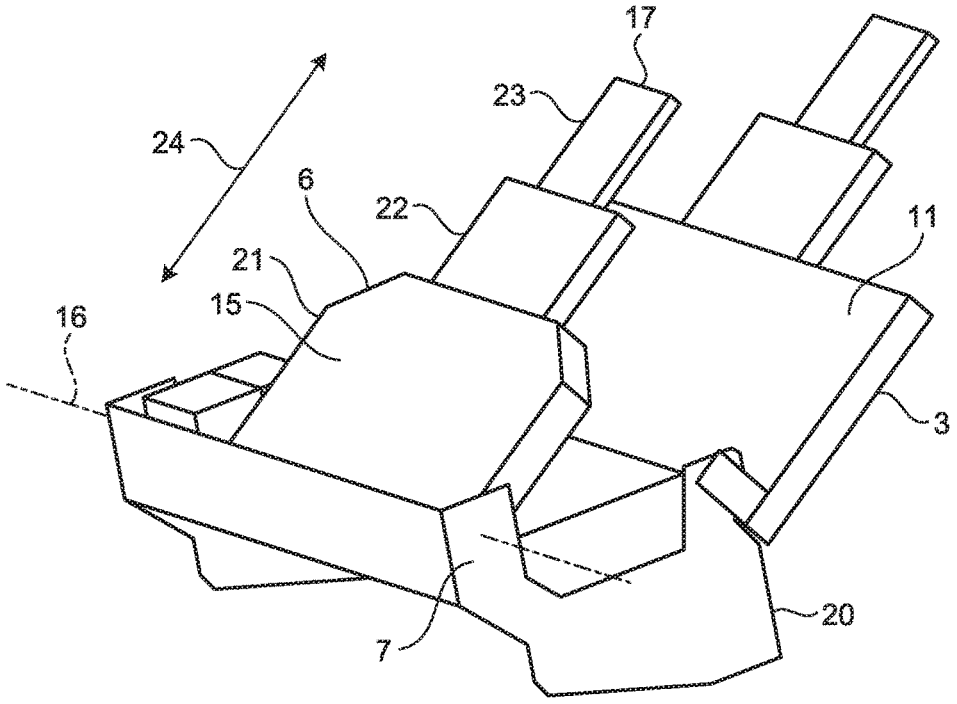
FIG. 2 is a perspective view illustrating a stacker and a shooter.

FIG. 2 is a perspective view illustrating the stacker and the shooter 3. As illustrated in FIG. 2, the image reading apparatus 1 further includes a frame 20. The frame 20 is arranged inside the body 2 and fixed to the body 2. The stacker 6 includes a first stacker member 21, a second stacker member 22, and a third stacker member 23. The first stacker member 21 is in the form of a plate and constitutes a part of the stacker mounting surface 15. The first stacker member 21 is supported on the frame 20 by the stacker supporting unit 7 so as to be able to rotate about the rotation axis 16. The second stacker member 22 is in the form of a plate that is thinner than the first stacker member 21, and constitutes a part of the stacker mounting surface 15. The second stacker member 22 is supported by the first stacker member 21 so as to be able to move parallel to an extending/contracting direction 24 such that the second stacker member 22 can be extended from inside the first stacker member 21 and pushed into inside the first stacker member 21. The extending/contracting direction 24 is perpendicular to the rotation axis 16 and parallel to the stacker mounting surface 15. The third stacker member 23 is in the form of a plate that is thinner than the second stacker member 22, and constitutes a part of the stacker mounting surface 15. The third stacker member 23 is supported by the second stacker member 22 so as to be able to move parallel to the extending/contracting direction 24 such that the third stacker member 23 can be extended from inside the second stacker member 22 and pushed to inside the second stacker member 22. With this configuration, the stacker 6 is constructed in an extendible-contractible manner so as to be shortened such that an end portion 17 located on the far side from the rotation axis 16 approaches the rotation axis 16 and so as to be extended such that the end portion 17 moves away from the rotation axis 16.

The stacker 6 further includes an interlocking mechanism (not illustrated). The interlocking mechanism converts motion of extending the second stacker member 22 from the first stacker member 21 and motion of pushing the second stacker member 22 to the first stacker member 21 into motion of extending the third stacker member 23 from the second stacker member 22 and motion of pushing the third stacker member 23 to the second stacker member 22. In other words, the interlocking mechanism mechanically converts motion of extending the second stacker member 22 from the first stacker member 21 into motion of extending the third stacker member 23 from the second stacker member 22. Further, the interlocking mechanism mechanically converts motion of pushing the second stacker member 22 to the first stacker member 21 into motion of pushing the third stacker member 23 to the second stacker member 22. With the interlocking mechanism as described above, the stacker 6 is extended and contracted by extending the second stacker member 22 from the first stacker member 21 and pushing the second stacker member 22 to the first stacker member 21.

Figure 3:
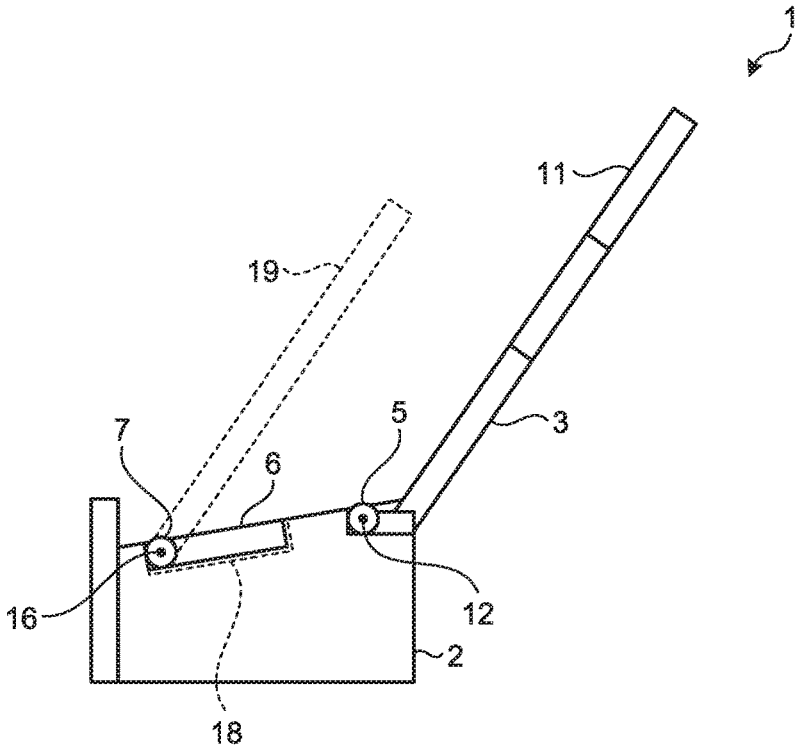
FIG. 3 is a side view illustrating the image reading apparatus in a case where the stacker is stored.

FIG. 3 is a side view illustrating the image reading apparatus 1 in a case where the stacker 6 is stored in the stacker storage region 18. As illustrated in FIG. 3, the stacker 6 is disposed and stored in the stacker storage region 18 by rotating the stacker 6 about the rotation axis 16 when the stacker 6 is shortened. In other words, the stacker supporting unit 7 supports the stacker 6 such that the stacker 6 can move so as to be disposed in the stacker storage region or a stacker extending region 19. The stacker extending region 19 is a region in which the stacker 6 is disposed in FIG. 1. In other words, when the stacker 6 is disposed in the stacker extending region 19, the stacker mounting surface 15 is oriented obliquely upward and the angle formed with the setting surface of the image reading apparatus 1 becomes substantially equal to 55 degrees.

When the stacker 6 is disposed in the stacker storage region 18, the shooter mounting surface 11 is exposed and the area of a region of the shooter mounting surface 11 covered by the stacker 6 is reduced as compared to a case in which the stacker 6 is disposed in the stacker extending region 19. In other words, the area of a figure that is obtained by orthogonally projecting the stacker 6 disposed in the stacker storage region 18 to the shooter mounting surface 11 is smaller than the area of a figure that is obtained by orthogonally projecting the stacker 6 disposed in the stacker extending region 19 to the shooter mounting surface 11.

Figure 4:
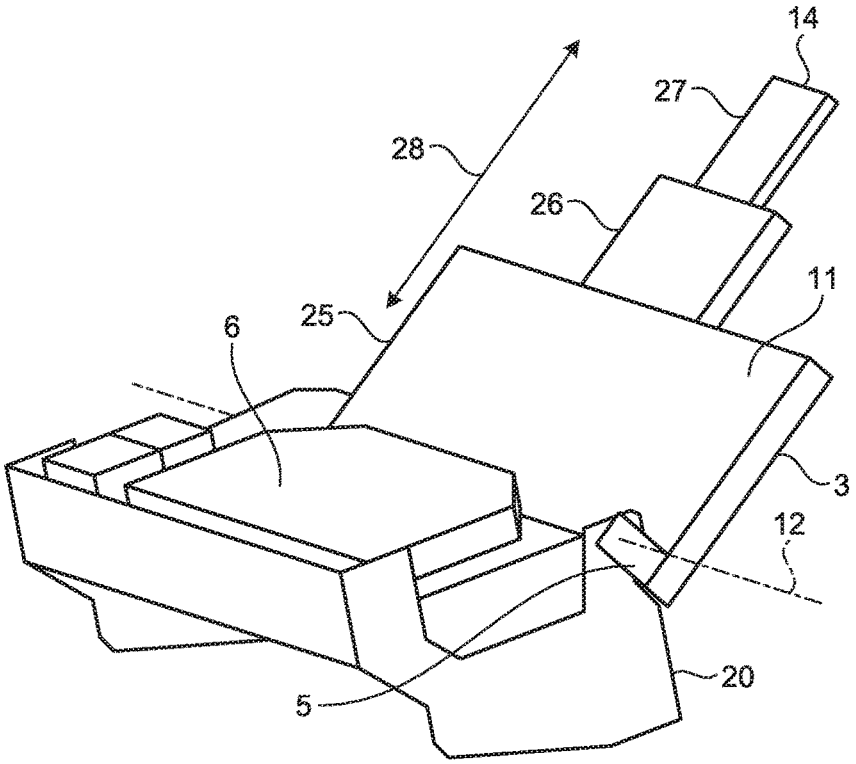
FIG. 4 is a perspective view illustrating the stacker and the shooter in a case where the stacker is stored.

FIG. 4 is a perspective view illustrating the stacker 6 and the shooter 3 in a case where the stacker 6 is stored in the stacker storage region 18. As illustrated in FIG. 4, the shooter 3 includes a first shooter member 25, a second shooter member 26, and a third shooter member 27. The first shooter member 25 is in the form of a plate and constitutes a part of the shooter mounting surface 11. The first shooter member 25 is supported on the frame 20 by the shooter supporting unit 5 so as to be able to rotate about the rotation axis 12. The second shooter member 26 is in the form of a plate that is thinner than the first shooter member 25 and constitutes a part of the shooter mounting surface 11. The second shooter member 26 is supported by the first shooter member 25 so as to be able to move parallel to an extending/contracting direction 28 such that the second shooter member 26 can be extended from inside the first shooter member 25 and pushed to inside the first shooter member 25. The extending/contracting direction 28 is perpendicular to the rotation axis 12 and parallel to the shooter mounting surface 11. The third shooter member 27 is in the form of a plate that is thinner than the second shooter member 26, and constitutes a part of the shooter mounting surface 11. The third shooter member 27 is supported by the second shooter member 26 so as to be able to move parallel to the extending/contracting direction 28 such that the third shooter member 27 can be extended from inside the second shooter member 26 and pushed to inside the second shooter member 26. With this configuration, the shooter 3 is constructed in an extendible-contractible manner so as to be shortened such that an end portion 14 located on the far side from the rotation axis 12 approaches the rotation axis 12 and so as to be extended such that the end portion 14 moves away from the rotation axis 12.

Figure 5:
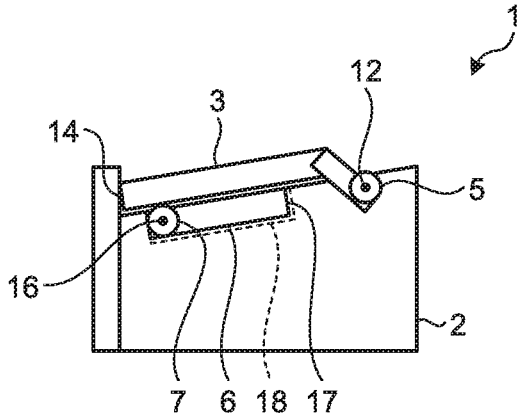
FIG. 5 is a side view illustrating the image reading apparatus in a case where the shooter is stored.
Figure 6:
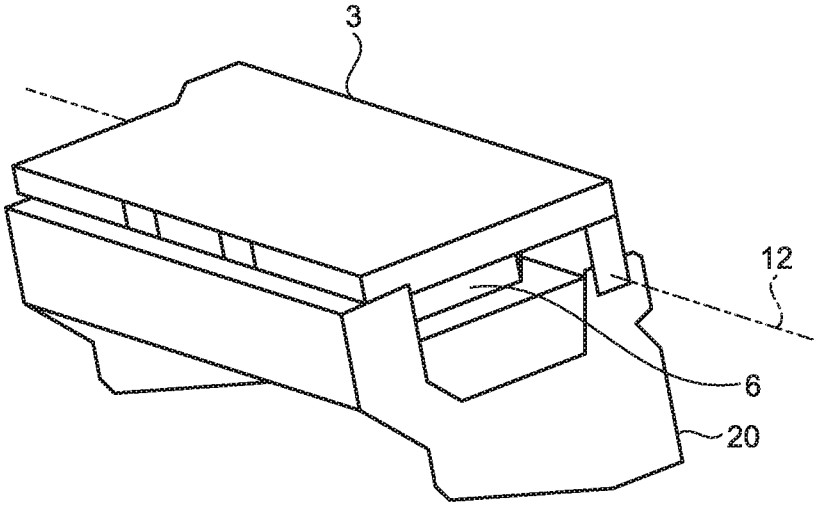
FIG. 6 is a perspective view illustrating the stacker and the shooter in a case where the shooter is stored.

FIG. 5 is a side view illustrating the image reading apparatus 1 in a case where the shooter 3 is stored. FIG. 6 is a perspective view illustrating the stacker 6 and the shooter 3 in a case where the shooter 3 is stored. As illustrated in FIG. 5, the shooter 3 can be disposed on an upper part of the stacker 6 by being rotated about the rotation axis 12 while the stacker 6 is stored in the stacker storage region 18. The shooter 3 is stored in such a manner that the shooter 3 is shortened and disposed on the upper part of the stacker 6. In other words, the shooter supporting unit 5 supports the shooter 3 to allow the shooter 3 to move such that the shooter 3 is extended as illustrated in FIG. 3 and the shooter 3 is stored in the upper part of the stacker 6 as illustrated in FIG. 5. By storing the shooter 3, the height of the image reading apparatus 1 is reduced, so that the size of the apparatus is reduced. Further, as illustrated in FIG. 6, the shooter 3 can cover the stacker 6 when the shooter 3 is stored.

Figure 7:
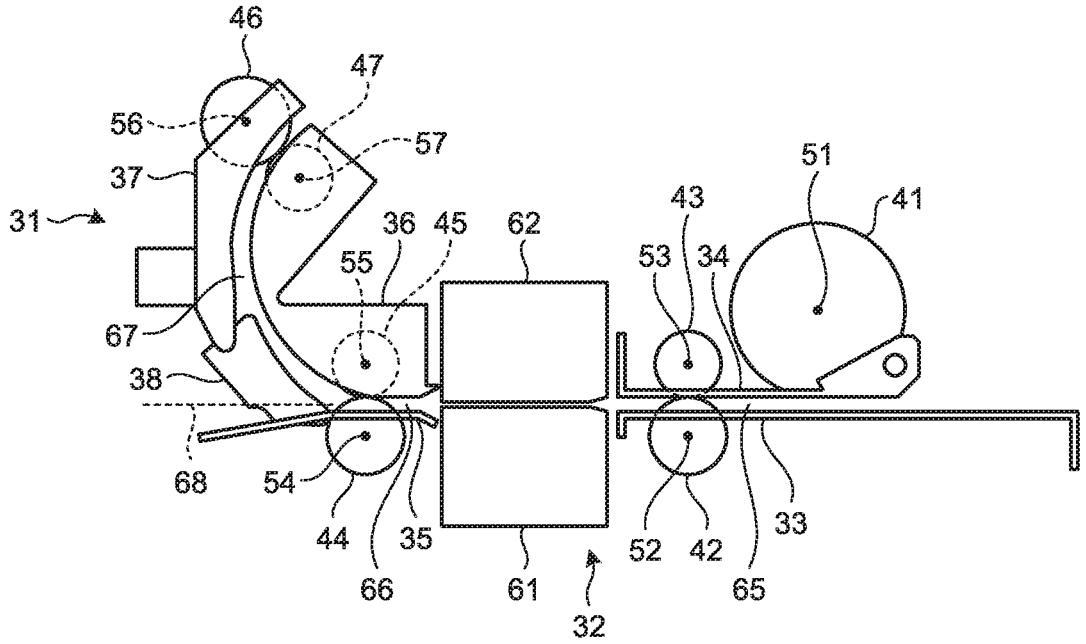
FIG. 7 is a cross-sectional view illustrating a conveying device and a reading device.

FIG. 7 is a cross-sectional view illustrating a conveying device 31 and a reading device 32. As illustrated in FIG. 7, the image reading apparatus 1 further includes the conveying device 31 and the reading device 32.

Conveying Device

The conveying device 31 is arranged inside the body 2. The conveying device 31 includes a plurality of conveying guides 33 to 37, a switching guide 38, and a plurality of conveying rollers 41 to 47. The plurality of conveying guides 33 to 37 include the first conveying guide 33, the second conveying guide 34, the third conveying guide 35, the fourth conveying guide 36, and the fifth conveying guide 37. The first conveying guide 33 is in the form of a substantially flat plate. The first conveying guide 33 is arranged along a plane that is substantially parallel to the setting surface of the image reading apparatus 1, and fixed to the frame 20. The second conveying guide 34 is in the form of a substantially flat plate. The second conveying guide 34 is arranged above the first conveying guide 33 so as to face the first conveying guide 33. Further, the second conveying guide 34 is supported by the frame 20 so as to be able to move up and down in the vertical direction.

The third conveying guide 35 is substantially in the form of a plate. The third conveying guide 35 is arranged on the front side of the first conveying guide 33 along the plane along which the first conveying guide 33 is arranged, and fixed to the frame 20. The fourth conveying guide 36 is in the form of a column, and a convex surface is formed along a part of a side surface of a cylinder. The fourth conveying guide 36 is arranged above the third conveying guide 35 such that a part of the convex surface faces the third conveying guide 35. The fourth conveying guide 36 is fixed to the frame 20. The fifth conveying guide 37 is in the form of a column, and a concave surface is formed along a part of a side surface of a cylinder. The fifth conveying guide 37 is arranged on the front side of the fourth conveying guide 36 such that the concave surface faces a part of the convex surface of the fourth conveying guide 36.

The conveying device 31 includes the plurality of conveying guides 33 to 37, so that a conveying path 65, a conveying path 66, a U-turn conveying path 67, and a straight conveying path 68 are formed. The conveying path 65 is formed between the first conveying guide 33 and the second conveying guide 34. The conveying path 65 is formed along the plane that is parallel to the setting surface of the image reading apparatus 1. Further, the conveying path 65 is formed so as to be connected to the shooter mounting surface 11 when the shooter 3 is extended. The conveying path 66 is formed between the third conveying guide 35 and the fourth conveying guide 36. The conveying path 66 is formed along the plane along which the conveying path 65 is formed.

The U-turn conveying path 67 is formed between the fourth conveying guide 36 and the fifth conveying guide 37. The U-turn conveying path 67 is formed along the side surfaces of the cylinders. Further, the U-turn conveying path 67 is formed so as to be connected to the stacker mounting surface 15 when the stacker 6 is disposed in the stacker extending region 19. The straight conveying path 68 is formed below the fifth conveying guide 37. The straight conveying path 68 is formed along the plane along which the conveying path 65 is formed. Further, the straight conveying path 68 is formed so as to be connected to an outer side of the body 2.

The switching guide 38 is substantially in the form of a plate, and supported by the frame 20 such that the switching guide 38 can move so as to be disposed at the U-turn path guide position or the straight path guide position. The switching guide 38 connects the conveying path 66 to the U-turn conveying path 67 when being disposed at the U-turn path guide position. The switching guide 38 connects the conveying path 66 to the straight conveying path 68 when being disposed at the straight path guide position.

The plurality of conveying rollers 41 to 47 include the first conveying roller 41, the second conveying roller 42, the third conveying roller 43, the fourth conveying roller 44, the fifth conveying roller 45, the sixth conveying roller 46, and the seventh conveying roller 47. The first conveying roller 41 is in the form of a cylinder and arranged above the conveying path 65. The first conveying roller 41 is supported by the frame 20 so as to be able to rotate about a rotation axis 51. The rotation axis 51 is parallel to the rotation axis 12. Further, the first conveying roller 41 is arranged so as to come in contact with a document that is placed on the shooter mounting surface 11 of the extended shooter 3. A single document that comes in contact with the first conveying roller 41 among a plurality of documents placed on the shooter mounting surface 11 is conveyed to the conveying path 65 when the first conveying roller 41 normally rotates (clockwise in FIG. 7) about the rotation axis 51.

The second conveying roller 42 is in the form of a cylinder and arranged on the front side relative to the first conveying roller 41 on a lower part of the conveying path 65. The second conveying roller 42 is supported by the frame 20 so as to be able to rotate about a rotation axis 52. The rotation axis 52 is parallel to the rotation axis 51. The third conveying roller 43 is in the form of a cylinder and arranged above the second conveying roller 42. The third conveying roller 43 is supported by the frame 20 so as to be able to rotate about a rotation axis 53 and move up and down in the vertical direction. The rotation axis 53 is parallel to the rotation axis 52. Further, the second conveying roller 42 and the third conveying roller 43 are arranged such that a document conveyed through the conveying path 65 is sandwiched between the second conveying roller 42 and the third conveying roller 43. The document conveyed through the conveying path 65 is conveyed to the conveying path 66 when the second conveying roller 42 normally rotates (counterclockwise in FIG. 7) about the rotation axis 52 and the third conveying roller 43 normally rotates (clockwise in FIG. 7) about the rotation axis 53. When the document conveyed through the conveying path 65 comes in contact with the second conveying guide 34, the second conveying guide 34 moves up and down with respect to the frame such that the second conveying guide 34 is disposed at a height corresponding to the thickness of the document. In other words, the height at which the second conveying guide 34 is disposed is increased as the thickness of the document conveyed through the conveying path 65 is increased. The third conveying roller 43 moves up and down such that the third conveying roller 43 is disposed at a height corresponding to the thickness of the document conveyed through the conveying path 65. In other words, the height at which the third conveying roller 43 is disposed is increased as the thickness of the document conveyed through the conveying path 65 is increased.

The fourth conveying roller 44 is in the form of a cylinder and arranged on a lower part of the conveying path 66. The fourth conveying roller 44 is supported by the frame 20 so as to be able to rotate about a rotation axis 54. The rotation axis 54 is parallel to the rotation axis 51. The fifth conveying roller 45 is in the form of a cylinder and arranged on an upper part of the conveying path 66. The fifth conveying roller 45 is supported by the frame 20 so as to be able rotate about a rotation axis 55 and move up and down in the vertical direction. The rotation axis 55 is parallel to the rotation axis 54. Further, the fourth conveying roller 44 and the fifth conveying roller 45 are arranged such that the document conveyed through the conveying path 66 is sandwiched between the fourth conveying roller 44 and the fifth conveying roller 45. The fifth conveying roller 45 moves up and down such that the fifth conveying roller 45 is disposed at a height corresponding to the thickness of the document conveyed through the conveying path 66. In other words, the height at which the fifth conveying roller 45 is disposed is increased as the thickness of the document conveyed by the conveying path 66 is increased.

The document conveyed by the conveying path 66 is conveyed to the U-turn conveying path 67 or the straight conveying path 68 when the fourth conveying roller 44 normally rotates (counterclockwise in FIG. 7) about the rotation axis 54 and the fifth conveying roller 45 normally rotates (clockwise in FIG. 7) about the rotation axis 55.

The sixth conveying roller 46 is in the form of a cylinder and arranged on the front side of the U-turn conveying path 67. The sixth conveying roller 46 is supported by the frame 20 so as to be able to rotate about a rotation axis 56. The rotation axis 56 is parallel to the rotation axis 51. The seventh conveying roller 47 is in the form of a cylinder and arranged on the rear side of the sixth conveying roller 46. The seventh conveying roller 47 is supported by the frame 20 so as to be able to rotate about a rotation axis 57. The rotation axis 57 is parallel to the rotation axis 56. Further, the sixth conveying roller 46 and the seventh conveying roller 47 are arranged such that the document conveyed through the U-turn conveying path 67 is sandwiched between the sixth conveying roller 46 and the seventh conveying roller 47. The document conveyed by the U-turn conveying path 67 is placed on the stacker mounting surface 15 of the stacker 6 in the stacker extending region 19 when the sixth conveying roller 46 normally rotates (counterclockwise in FIG. 7) and the seventh conveying roller 47 normally rotates (clockwise in FIG. 7).

With this configuration, the conveying device 31 conveys a document arranged at the top of documents placed on the shooter 3 to the conveying paths 65 and 66. Further, the conveying device 31 conveys the document that has been conveyed from the conveying path 66 to the U-turn conveying path 67 to the stacker 6, and places the document on the stacker mounting surface 15. At this time, a surface of the document that faces the shooter mounting surface 11 when the document is placed on the shooter 3 is a back surface of the surface that faces the stacker mounting surface 15 when the document is placed on the stacker mounting surface 15 of the stacker 6. Furthermore, the conveying device 31 discharges the document that has been conveyed from the conveying path 66 to the straight conveying path 68 to the outside of the body 2. Meanwhile, the degree of bend of the U-turn conveying path 67 is larger than the straight conveying path 68. Therefore, the degree of deformation of a document that passes through the U-turn conveying path 67 is larger than the degree of deformation of a document that passes through the straight conveying path 68.

Reading Device

The reading device 32 is arranged between the conveying path 65 and the conveying path 66 inside the body 2. The reading device 32 includes a lower image sensor 61 and an upper image sensor 62. The lower image sensor 61 is arranged below the plane along which the conveying path 65 and the conveying path 66 are formed, and is fixed to the frame 20. The lower image sensor 61 is configured using a contact image sensor (CIR) type image sensor. The lower image sensor 61 comes in contact with a lower reading surface of the document that is conveyed from the conveying path 65 to the conveying path 66, illuminates the reading surface, receives light reflected from the reading surface, and reads an image on the reading surface. The upper image sensor 62 is arranged above the plane along which the conveying path 65 and the conveying path 66 are formed, and is supported by the frame 20 so as to be able to move parallel to the vertical direction. The upper image sensor 62 is configured using a CIS type image sensor. The upper image sensor 62 comes in contact with an upper reading surface of the document conveyed from the conveying path 65 to the conveying path 66, illuminates the reading surface, receives light reflected from the reading surface, and reads an image on the reading surface.

Figure 8:
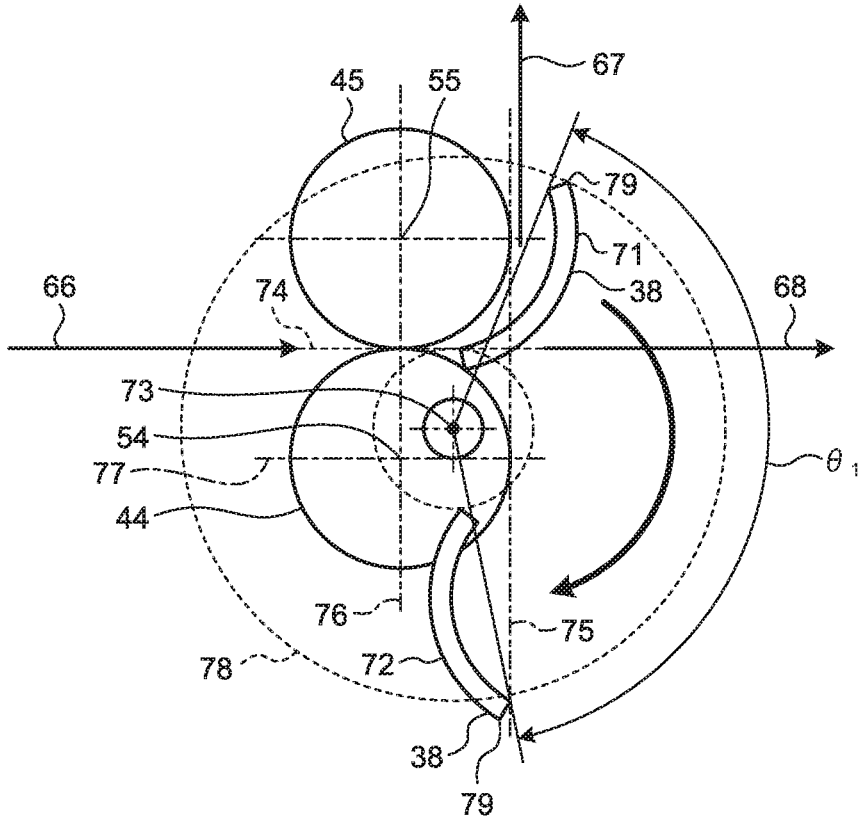
FIG. 8 is a schematic cross-sectional view illustrating a part of the conveying device 31.

FIG. 8 is a schematic cross-sectional view illustrating a part of the conveying device 31. As illustrated in FIG. 8, the switching guide 38 is supported by the frame 20 so as to be able to rotate about a rotation axis 73 such that the switching guide 38 can be arranged at a U-turn path guide position 71 or a straight path guide position 72. The rotation axis 73 is parallel to the rotation axis 54. The rotation axis 73 is arranged below a plane 74 along which the conveying path 66 is formed. The rotation axis 73 is parallel to the rotation axis 54. Further, the rotation axis 73 is arranged on the rear side relative to a vertical plane 75 that comes in contact with a front edge of the fourth conveying roller 44 among vertical planes that are parallel to the rotation axis 54. Furthermore, the rotation axis 73 is arranged on the front side relative to a vertical plane 76 that includes the rotation axis 54 among the vertical planes that are parallel to the rotation axis 54. Moreover, the rotation axis 73 is arranged above a plane 77 that includes the rotation axis 54 among planes that are parallel to the plane 74. Furthermore, the rotation axis 73 is arranged so as to cross the fourth conveying roller 44.

When the switching guide 38 is disposed at the U-turn path guide position 71, a part of the switching guide 38 comes in contact with the third conveying guide 35 and another part of the switching guide 38 comes in contact with the fifth conveying guide 37. When disposed at the U-turn path guide position 71, the switching guide 38 separates the conveying path 66 and the straight conveying path 68, and connects the conveying path 66 to the U-turn conveying path 67. The switching guide 38 moves to the straight path guide position 72 by normally rotating (clockwise in FIG. 8) by an angle 61 about the rotation axis 73 from the U-turn path guide position 71.

The switching guide 38 is arranged below the U-turn path guide position 71 such that when the switching guide 38 is disposed at the straight path guide position 72, the switching guide 38 is separated from the third conveying guide 35 and the fifth conveying guide 37 and such that the conveying path 66 and the straight conveying path 68 are not separated from each other. The switching guide 38 is arranged on the rear side relative to the vertical plane 75 such that the switching guide 38 does not protrude to the front side relative to the vertical plane 75 when the switching guide 38 is disposed at the straight path guide position 72. When disposed at the straight path guide position 72, the switching guide 38 does not separate the conveying path 66 and the straight conveying path 68 from each other and connects the conveying path 66 to the straight conveying path 68. The switching guide 38 moves to the U-turn path guide position 71 by reversely rotating (counterclockwise in FIG. 8) by an angle 61 about the rotation axis 73 from the straight path guide position 72.

The switching guide 38 moves between the U-turn path guide position 71 and the straight path guide position 72 such that an end 79 of the switching guide 38 on the far side from the rotation axis 73 moves along a trajectory 78. A portion of the trajectory 78 that protrudes to the front side from the vertical plane 75 is relatively small. Therefore, in the image reading apparatus 1, a space that protrudes from the vertical plane 75 when the switching guide 38 moves between the U-turn path guide position 71 and the straight path guide position 72 is relatively small, so that a setting space of the apparatus can be relatively reduced.

Figure 9:
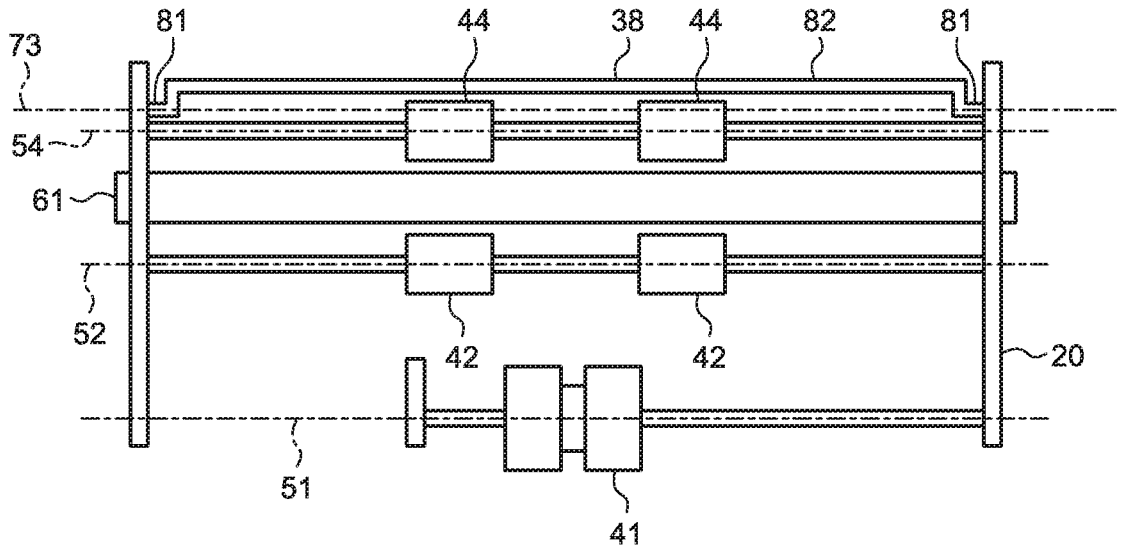
FIG. 9 is a schematic top view illustrating a part of the conveying device 31.

FIG. 9 is a schematic top view illustrating a part of the conveying device 31. As illustrated in FIG. 9, the switching guide 38 includes two supporting portions 81 and a guiding portion 82. Each of the two supporting portions 81 is in the form of a cylinder, arranged so as to overlap the rotation axis 73, and supported by the frame 20 so as to be able to rotate about the rotation axis 73. The guiding portion 82 is formed such that both ends thereof are bonded to the two supporting portions 81 and the guiding portion 82 does not overlap the rotation axis 73. With this configuration, the switching guide 38 can rotate about the rotation axis 73 without interfering with the fourth conveying roller 44 and can be disposed at the U-turn path guide position 71 and the straight path guide position 72.

Figure 10:
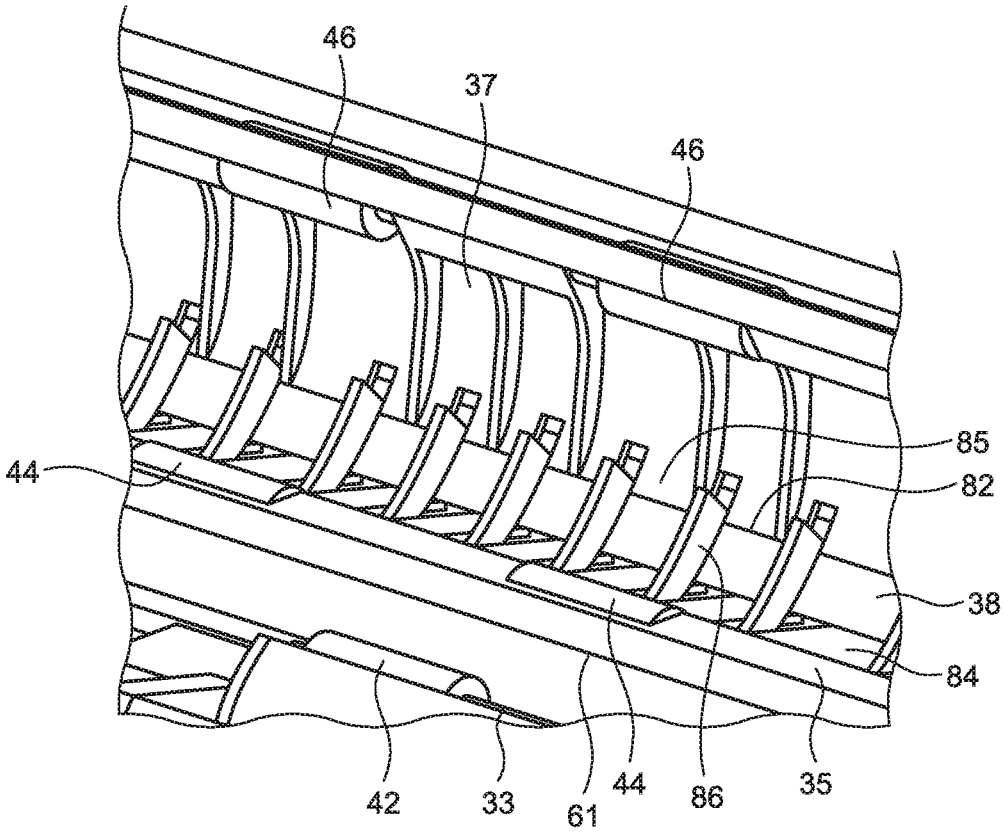
FIG. 10 is a perspective view illustrating a third conveying guide, a fifth conveying guide, and a switching guide.

FIG. 10 is a perspective view illustrating the third conveying guide 35, the fifth conveying guide 37, and the switching guide 38. As illustrated in FIG. 10, the third conveying guide 35 includes a plurality of teeth 84 on a front edge. The plurality of teeth 84 are formed in a comb teeth manner. In other words, each of the teeth 84 is in the form of a substantially rectangular plate, and protrudes to the front side from the front edge of the third conveying guide 35 along the plane along which the third conveying guide 35 is formed.

The fifth conveying guide 37 includes a plurality of teeth 85 at a lower edge. The plurality of teeth 85 are formed in a comb teeth manner. In other words, each of the teeth 85 is in the form of a substantially rectangular plate, and protrudes to the lower side from the lower edge of the fifth conveying guide 37 along the plane along which the fifth conveying guide 37 is formed.

The switching guide 38 includes a plurality of teeth 86. Each of the teeth 86 is in the form of a rectangular plate, arranged along a plurality of parallel planes that are perpendicular to the rotation axis 73, and bonded to the guiding portion 82. The switching guide 38 is formed such that the plurality of teeth 86 engage with the plurality of teeth 84 of the third conveying guide 35 when the switching guide 38 is disposed at the U-turn path guide position 71. In other words, tips of the plurality of teeth 86 protrude from gaps between the plurality of teeth 84 when the switching guide 38 is disposed at the U-turn path guide position 71. Further, the switching guide 38 is formed such that the plurality of teeth 86 engage with the plurality of teeth 85 of the fifth conveying guide 37 when the switching guide 38 is disposed at the U-turn path guide position 71. In other words, tips of the plurality of teeth 86 protrude from gaps between the plurality of teeth 85 when the switching guide 38 is disposed at the U-turn path guide position 71. The switching guide 38 connects the conveying path 66 to the U-turn conveying path 67 by causing the tips of the plurality of teeth 86 to protrude from the gaps between the plurality of teeth 84 and causing the tips of the plurality of teeth 86 to protrude from the gaps between the plurality of teeth 85.

When disposed at the straight path guide position 72, the switching guide 38 opens a space between the third conveying guide 35 and the fifth conveying guide 37 by preventing the plurality of teeth 85 from engaging with the plurality of teeth 86 and the plurality of teeth 84. The switching guide 38 connects the conveying path 66 to the straight conveying path 68 by opening the space between the third conveying guide 35 and the fifth conveying guide 37.

Figure 11:
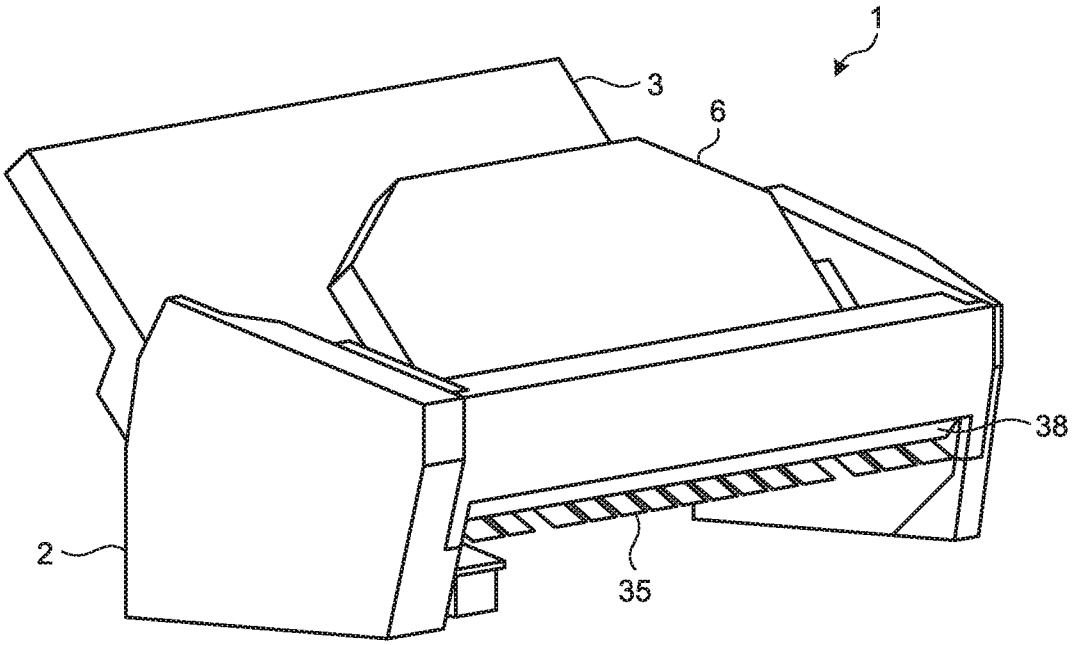
FIG. 11 is a perspective view illustrating the image reading apparatus in a case where the switching guide is arranged at a U-turn path guide position.

FIG. 11 is a perspective view illustrating the image reading apparatus 1 in a case where the switching guide 38 is disposed at the U-turn path guide position 71. As illustrated in FIG. 11, the switching guide 38 closes the space between the third conveying guide 35 and the fifth conveying guide 37 such that the conveying path 66 is hidden from outside when the switching guide 38 is disposed at the U-turn path guide position 71.

Figure 12:
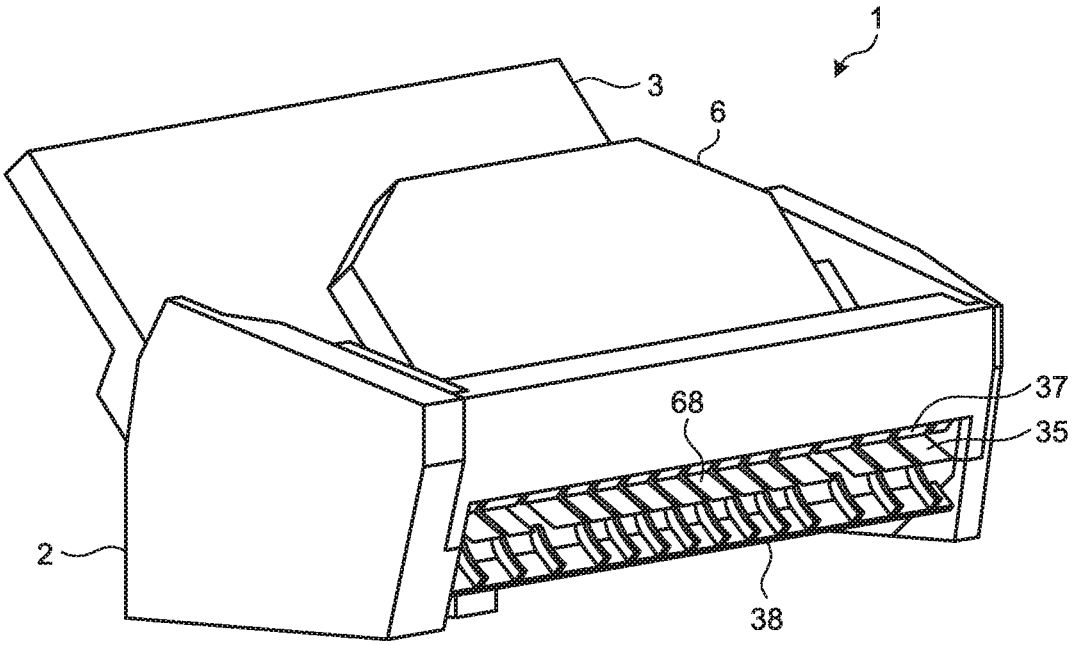
FIG. 12 is a perspective view illustrating the image reading apparatus in a case where the switching guide is arranged at a straight path guide position.

FIG. 12 is a perspective view illustrating the image reading apparatus 1 in a case where the switching guide 38 is disposed at the straight path guide position 72. As illustrated in FIG. 12, the switching guide 38 is arranged below the third conveying guide 35 when the switching guide 38 is disposed at the straight path guide position 72. By being arranged below the third conveying guide 35, the switching guide 38 does not disturb a user when the user views the straight conveying path 68, so that the user can easily view the straight conveying path 68.

Figure 13:
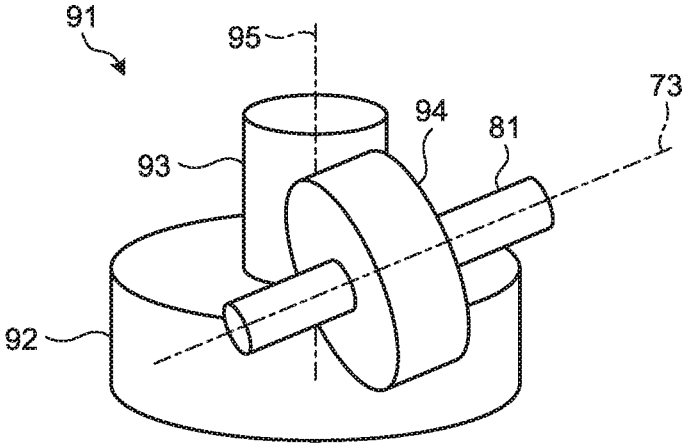
FIG. 13 is a perspective view illustrating a switching guide drive transmission system.

The switching guide 38 includes a switching guide drive transmission system 91. FIG. 13 is a perspective view illustrating the switching guide drive transmission system 91. As illustrated in FIG. 13, the switching guide drive transmission system 91 includes a motor 92, a worm 93, and a worm wheel 94. The worm 93 is in the form of a cylinder and supported by the frame 20 so as to be able to rotate about a rotation axis 95. The rotation axis 95 is substantially perpendicular to the rotation axis 73 of the switching guide 38 and arranged so as not to cross the rotation axis 73. The worm 93 includes spiral teeth on an outer periphery. The motor 92 normally or reversely rotates the worm 93. The worm wheel 94 is in the form of a circular disk, supported by the frame 20 so as to be able to rotate about the rotation axis 73, and fixed to one of the two supporting portions 81 of the switching guide 38. The worm wheel 94 includes, on an end face of the circular disk, teeth that engage with the teeth of the worm 93.

The switching guide drive transmission system 91 can normally rotate the worm wheel 94 and normally rotate the switching guide 38 when the motor 92 normally rotates the worm 93. Further, the switching guide drive transmission system 91 can reversely rotate the worm wheel 94 and reversely rotate the switching guide 38 when the motor 92 reversely rotates the worm 93. In other words, the switching guide drive transmission system 91 can dispose the switching guide 38 at the straight path guide position 72 when the motor 92 normally rotates the worm 93 while the switching guide 38 is disposed at the U-turn path guide position 71. The switching guide drive transmission system 91 can dispose the switching guide 38 at the U-turn path guide position 71 when the motor 92 normally rotates the worm 93 while the switching guide 38 is disposed at the straight path guide position 72.

Further, the switching guide drive transmission system 91 has a self-lock function for preventing rotation of the worm wheel 94 from being converted to rotation of the worm 93. Due to the self-lock function of the switching guide drive transmission system 91, the switching guide 38 is fixed so as not to rotate when the motor 92 does not rotate the worm 93. In other words, the switching guide drive transmission system 91 can fix the switching guide 38 such that the switching guide 38 does not rotate when the motor 92 does not rotate the worm 93 while the switching guide 38 is disposed at the U-turn path guide position 71 or the straight path guide position 72.

The image reading apparatus 1 further includes a thickness sensor and a control device (not illustrated). The thickness sensor measures a thickness of a document conveyed through the conveying path 65. The control device controls the switching guide drive transmission system 91 of the switching guide 38 such that the switching guide 38 is disposed at any of the U-turn path guide position 71 and the straight path guide position 72, on the basis of the document thickness measured by the thickness sensor. The control device controls the switching guide drive transmission system 91 of the switching guide 38 such that the switching guide 38 is disposed at the U-turn path guide position 71 when the document thickness measured by the thickness sensor is smaller than a predetermined threshold. The control device controls the switching guide drive transmission system 91 of the switching guide 38 such that the switching guide 38 is disposed at the straight path guide position 72 when the document thickness measured by the thickness sensor is larger than the predetermined threshold.

Operation of Image Reading Apparatus

When a user wants to read images on documents using the image reading apparatus 1, the user first opens up the shooter 3 and extends the shooter 3. After opening up and extending the shooter 3, the user places the documents to be read using the image reading apparatus 1 on the shooter mounting surface 11. After placing the documents on the shooter mounting surface 11, the user opens up the stacker 6 and extends the stacker 6 such that the stacker 6 is disposed in the stacker extending region 19. After the stacker 6 is disposed in the stacker extending region 19, the user operates the image reading apparatus 1 such that the images on the documents placed on the shooter 3 are read by the image reading apparatus 1.

When the user operates the image reading apparatus 1, the conveying device 31 normally rotates the plurality of rollers 41 to 47. When the plurality of rollers 41 to 47 normally rotate, the conveying device 31 conveys the documents placed on the shooter mounting surface 11 one by one from the shooter mounting surface 11 to the conveying path 65, and conveys the documents from the conveying path 65 to the conveying path 66. When a document is conveyed from the conveying path 65 to the conveying path 66, the lower image sensor 61 of the reading device 32 comes in contact with a lower reading surface of the document and reads an image on the reading surface and the upper image sensor 62 of the reading device 32 comes in contact with an upper reading surface of the document and reads an image on the reading surface.

The control device of the image reading apparatus 1 controls the thickness sensor and measures the thickness of the document. When the thickness of the document is smaller than a predetermined threshold, the control device of the image reading apparatus 1 controls the switching guide drive transmission system 91 such that the switching guide 38 is disposed at the U-turn path guide position 71. When the thickness of the document is larger than the predetermined threshold, the control device of the image reading apparatus 1 controls the switching guide drive transmission system 91 such that the switching guide 38 is disposed at the straight path guide position 72.

When disposed at the U-turn path guide position 71, the switching guide 38 guides the document, which has been conveyed to the conveying path 66, to the U-turn conveying path 67. The conveying device 31 conveys the document, which has been guided to the U-turn conveying path 67, to the stacker 6 and places the document on the stacker mounting surface 15 of the stacker 6. When disposed at the straight path guide position 72, the switching guide 38 guides the document, which has been conveyed to the conveying path 66, to the straight conveying path 68. The conveying device 31 discharges the document, which has been guided to the straight conveying path 68, to the outside of the body 2.

Examples of the document whose thickness is smaller than the predetermined threshold include paper. Such a document has flexibility and is less likely to be deformed even when conveyed through the U-turn conveying path 67, so that a paper jam is less likely to occur in the U-turn conveying path 67. Examples of the document whose thickness is larger than the predetermined threshold include a cardboard, a plastic card, such as a credit card. Such a document is likely to be deformed when conveyed through the U-turn conveying path 67 or is likely to cause a paper jam in the U-turn conveying path 67. According to the operation as described above, the image reading apparatus 1 prevents occurrence of a paper jam in the U-turn conveying path 67 by discharging a document with a large thickness via the straight conveying path 68 without conveying the document through the U-turn conveying path 67.

The switching guide 38 is arranged below the plane 74 when the switching guide 38 is disposed at the straight path guide position 72, and therefore does not disturb a user when the user views the document that is discharged via the straight conveying path 68. Therefore, the image reading apparatus 1 ensures good visibility of the document that is discharged via the straight conveying path 68. The switching guide 38 is arranged on the rear side relative to the vertical plane 75 when disposed at the straight path guide position 72 and therefore is less likely to come in contact with the document that is discharged via the straight conveying path 68, so that the document can be discharged appropriately.

First Comparative Example of Switching Guide

Figure 14:
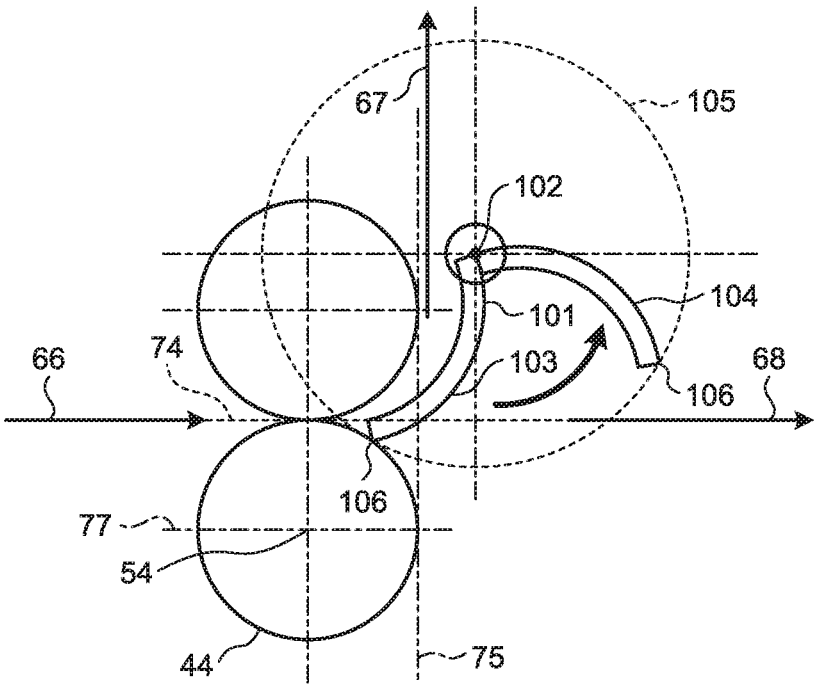
FIG. 14 is a schematic cross-sectional view illustrating a switching guide of an image reading apparatus according to a first comparative example.

FIG. 14 illustrates a switching guide 101 of an image reading apparatus according to a first comparative example. As illustrated in FIG. 14, the image reading apparatus of the first comparative example includes the switching guide 101 instead of the switching guide 38 of the image reading apparatus 1 of the first embodiment described above. The switching guide 101 is supported by the frame 20 so as to be able to rotate about a rotation axis 102. The rotation axis 102 is arranged near an upper edge of the switching guide 101. In other words, the rotation axis 102 is arranged above the plane 74 and on the front side relative to the vertical plane 75.

The switching guide 101 can be disposed at a U-turn path guide position 103 and a straight path guide position 104 by rotating about the rotation axis 102. When disposed at the U-turn path guide position 103, the switching guide 101 guides a document that has been conveyed through the conveying path 66 to the U-turn conveying path 67. When disposed at the straight path guide position 104, the switching guide 101 guides a document that has been conveyed through the conveying path 66 to the straight conveying path 68.

The switching guide 101 moves between the U-turn path guide position 103 and the straight path guide position 104 such that an end 106 of the switching guide 101 on the far side from the rotation axis 102 moves along a trajectory 105. The trajectory 105 indicates that an amount that the end 106 of the switching guide 101 of the image reading apparatus of the first comparative example protrudes from the vertical plane 75 is larger than the amount that the end 79 of the switching guide of the image reading apparatus 1 of the first embodiment protrudes from the vertical plane 75. Therefore, the image reading apparatus 1 of the first embodiment can reduce the setting space as compared to the image reading apparatus of the first comparative example.

Second Comparative Example of Switching Guide

Figure 15:
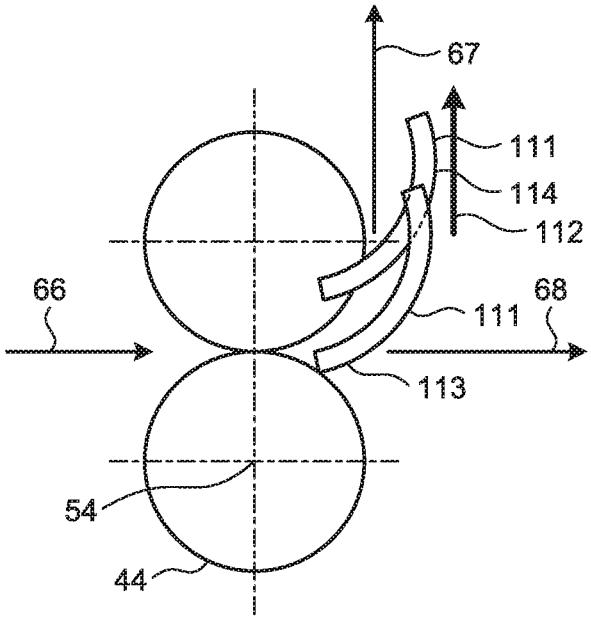
FIG. 15 is a schematic cross-sectional view illustrating a switching guide of an image reading apparatus according to a second comparative example.

FIG. 15 illustrates a switching guide 111 of an image reading apparatus according to a second comparative example. As illustrated in FIG. 15, the image reading apparatus of the second comparative example includes the switching guide 111 instead of the switching guide 38 of the image reading apparatus 1 of the first embodiment described above. The switching guide 111 is supported by the frame 20 so as to be able to move parallel to a vertical direction 112.

The switching guide 111 can be disposed at a U-turn path guide position 113 and a straight path guide position 114 by moving up and down. When disposed at the U-turn path guide position 113, the switching guide 111 guides a document that has been conveyed through the conveying path 66 to the U-turn conveying path 67. When disposed at the straight path guide position 114, the switching guide 111 guides a document that has been conveyed through the conveying path 66 to the straight conveying path 68.

A mechanism that supports a member such that the member can rotate is more easily manufactured at a lower manufacturing cost as compared to a mechanism that supports a member such that the member can move in a parallel manner. Therefore, the image reading apparatus 1 of the first embodiment can be more easily manufactured at a lower manufacturing cost as compared to the image reading apparatus of the second comparative example, so that the image reading apparatus 1 of the first embodiment is preferable.

Third Comparative Example of Switching Guide

Figure 16:
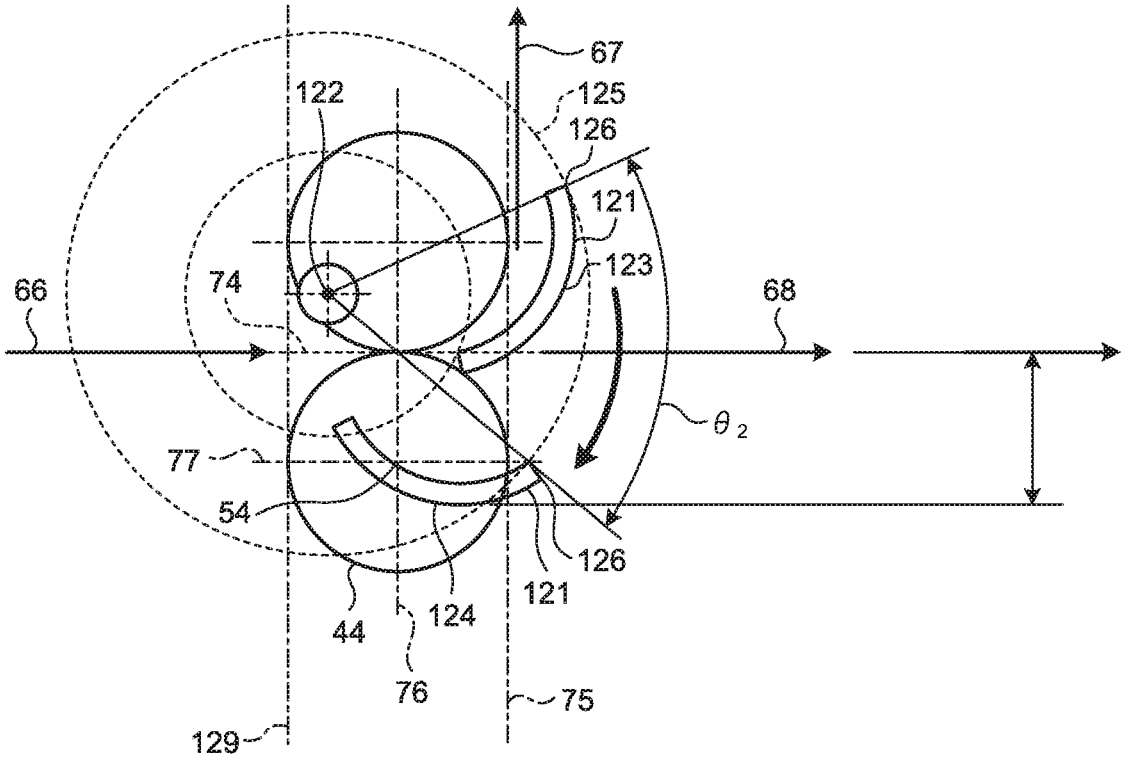
FIG. 16 is a schematic cross-sectional view illustrating a switching guide of an image reading apparatus according to a third comparative example.

FIG. 16 illustrates a switching guide 121 of an image reading apparatus according to a third comparative example. As illustrated in FIG. 16, the image reading apparatus of the third comparative example includes the switching guide 121 instead of the switching guide 38 of the image reading apparatus 1 of the first embodiment described above. The switching guide 121 is supported by the frame 20 so as to be able to rotate about a rotation axis 122. The rotation axis 122 is arranged above the plane 74. Further, the rotation axis 122 is arranged on the rear side relative to the vertical plane 75 and on the front side relative to a vertical plane 129 that comes in contact with a rear edge of the fourth conveying roller 44 among vertical planes that are parallel to the rotation axis 54.

The switching guide 121 can be disposed at a U-turn path guide position 123 and a straight path guide position 124 by rotating about the rotation axis 122. In other words, the switching guide 121 moves to the straight path guide position 124 by normally rotating (clockwise in FIG. 16) by an angle 62 about the rotation axis 122 from the U-turn path guide position 123. The switching guide 121 moves to the U-turn path guide position 123 by reversely rotating (counterclockwise in FIG. 16) by the angle 62 about the rotation axis 122 from the straight path guide position 124. When disposed at the U-turn path guide position 123, the switching guide 121 guides a document that has been conveyed through the conveying path 66 to the U-turn conveying path 67. When disposed at the straight path guide position 124, the switching guide 121 guides a document that has been conveyed through the conveying path 66 to the straight conveying path 68.

The switching guide 121 moves between the U-turn path guide position 123 and the straight path guide position 124 such that an end 126 of the switching guide 121 on the far side from the rotation axis 122 moves along a trajectory 125. The trajectory 125 indicates that a portion of the switching guide 121 that protrudes to the front side from the vertical plane 75 when the switching guide 121 rotates is relatively small. When the switching guide 121 is disposed at the straight path guide position 124, a large portion of the switching guide 121 crosses the fourth conveying roller 44. Therefore, the switching guide 121 has a large notch so as not to interfere with the fourth conveying roller 44 when the switching guide 121 is disposed at the straight path guide position 124. Due to the large notch, the strength of the switching guide 121 is reduced or the switching guide 121 may fail to appropriately guide a document to the U-turn conveying path 67 when disposed at the U-turn path guide position 123.

In the switching guide 38 of the image reading apparatus 1 of the first embodiment, a portion that crosses the fourth conveying roller 44 when the switching guide 38 is disposed at the straight path guide position 72 is smaller than that of the switching guide 121 of the image reading apparatus of the third comparative example (see FIG. 8). Therefore, the image reading apparatus 1 of the first embodiment can reduce a notch formed in the switching guide 38 as compared to the switching guide 121 of the image reading apparatus of the third comparative example, and therefore can appropriately guide a document to the U-turn conveying path 67.

Fourth Comparative Example of Switching Guide

Figure 17:
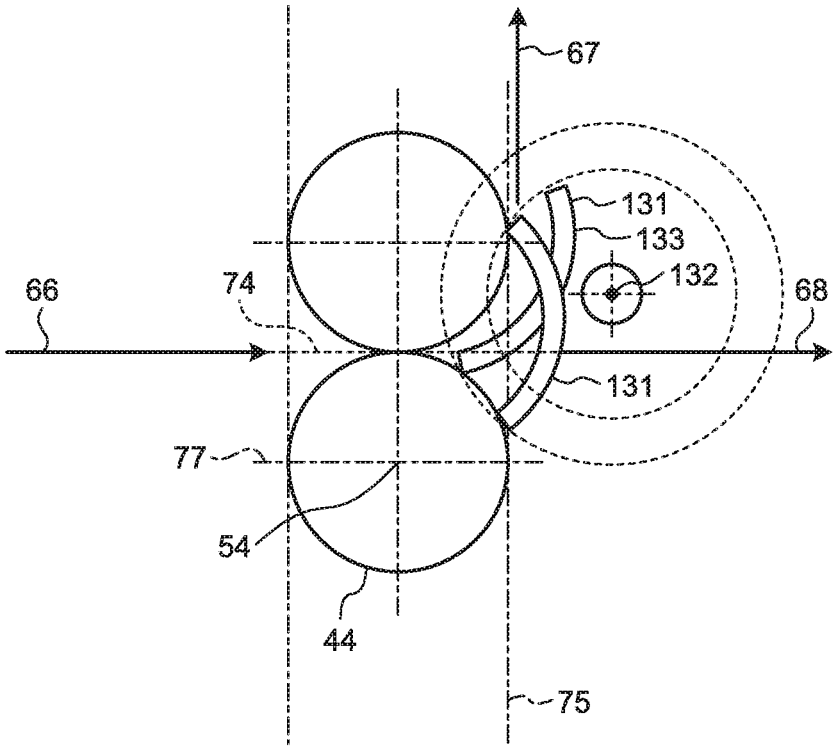
FIG. 17 is a schematic cross-sectional view illustrating a switching guide of an image reading apparatus according to a fourth comparative example.

FIG. 17 illustrates a switching guide 131 of an image reading apparatus according to a fourth comparative example. As illustrated in FIG. 17, the image reading apparatus of the fourth comparative example includes the switching guide 131 instead of the switching guide 38 of the image reading apparatus 1 of the first embodiment described above. The switching guide 131 is supported by the frame 20 so as to be able to rotate about a rotation axis 132. The rotation axis 132 is arranged above the plane 74. Further, the rotation axis 132 is arranged on the front side relative to the vertical plane 75.

When disposed at a U-turn path guide position 133, the switching guide 131 guides a document that has been conveyed through the conveying path 66 to the U-turn conveying path 67. The switching guide 131 can be disposed such that the conveying path 66 and the straight conveying path 68 are not separated from each other by rotating from the U-turn path guide position 133, and can guide a document that has been conveyed through the conveying path 66 to the straight conveying path 68. For example, the entire switching guide 131 is arranged above the rotation axis 132 so as to be disposed such that the conveying path 66 and the straight conveying path are not separated from each other, and can guide the document that has been conveyed through the conveying path 66 to the straight conveying path 68. However, the entire switching guide 131 is not arranged below the plane 74 when rotating from the U-turn path guide position 133.

In the image reading apparatus 1 of the first embodiment, the switching guide 38 is arranged below the plane 74 when the switching guide 38 is disposed at the straight path guide position 72, so that the visibility of a document that is discharged via the straight conveying path 68 can be improved as compared to the image reading apparatus of the fourth comparative example.

Fifth Comparative Example of Switching Guide

Figure 18:
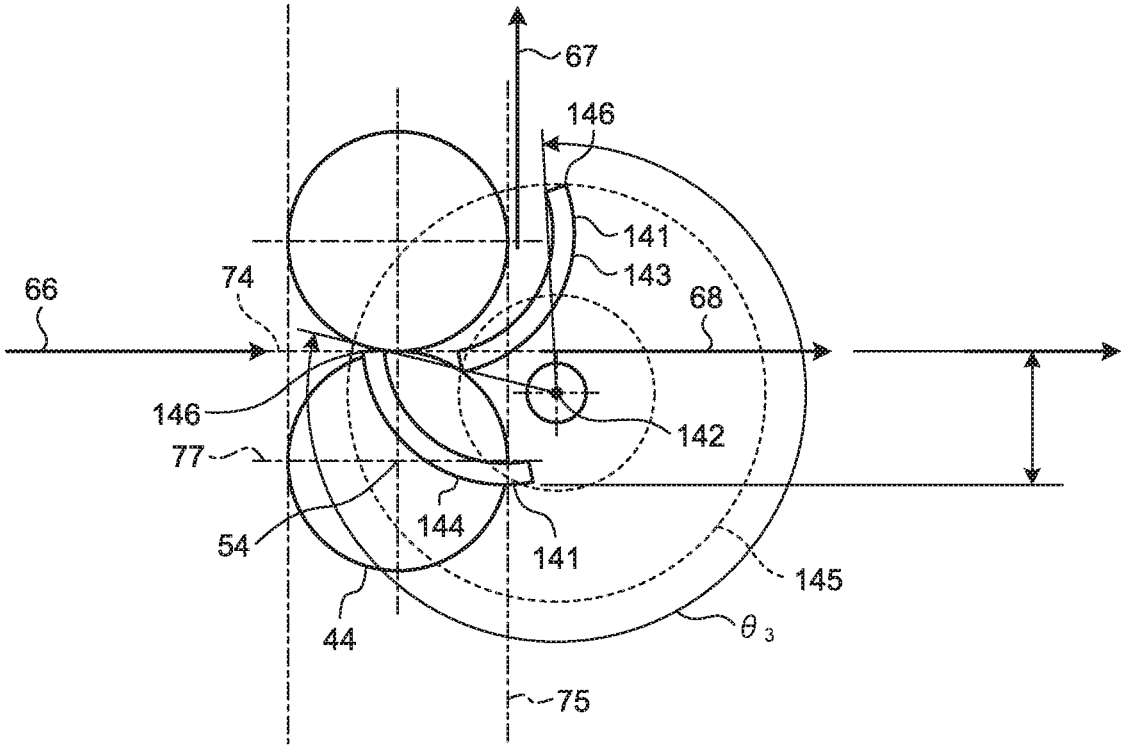
FIG. 18 is a schematic cross-sectional view illustrating a switching guide of an image reading apparatus according to a fifth comparative example.

FIG. 18 illustrates a switching guide 141 of an image reading apparatus according to a fifth comparative example. As illustrated in FIG. 18, the image reading apparatus of the fifth comparative example includes the switching guide 141 instead of the switching guide 38 of the image reading apparatus 1 of the first embodiment described above. The switching guide 141 is supported by the frame 20 so as to be able to rotate about a rotation axis 142. The rotation axis 142 is arranged below the plane 74. Further, the rotation axis 142 is arranged on the front side relative to the vertical plane 75.

The switching guide 141 can be disposed at a U-turn path guide position 143 and a straight path guide position 144 by rotating about the rotation axis 142. In other words, the switching guide 141 moves to the straight path guide position 144 by normally rotating (clockwise in FIG. 18) by an angle 63 about the rotation axis 142 from the U-turn path guide position 143. The switching guide 141 moves to the U-turn path guide position 143 by reversely rotating (counterclockwise in FIG. 18) by the angle 63 about the rotation axis 142 from the straight path guide position 144. When disposed at the U-turn path guide position 143, the switching guide 141 guides a document that has been conveyed through the conveying path 66 to the U-turn conveying path 67. When disposed at the straight path guide position 144, the switching guide 141 guides a document that has been conveyed through the conveying path 66 to the straight conveying path 68.

The switching guide 141 moves between the U-turn path guide position 143 and the straight path guide position 144 such that an end 146 of the switching guide 141 on the far side from the rotation axis 142 moves along a trajectory 145. The trajectory 145 indicates that a portion of the switching guide 141 that protrudes to the front side from the vertical plane 75 when the switching guide 141 rotates is relatively large. When the switching guide 141 is disposed at the straight path guide position 144, a large portion of the switching guide 141 crosses the fourth conveying roller 44. Therefore, the switching guide 141 has a large notch so as not to interfere with the fourth conveying roller 44 when the switching guide 141 is disposed at the straight path guide position 144. Due to the large notch, the strength of the switching guide 141 is reduced or the switching guide 141 may fail to appropriately guide a document to the U-turn conveying path 67 when disposed at the U-turn path guide position 143.

In the switching guide 38 of the image reading apparatus 1 of the first embodiment, a portion that crosses the fourth conveying roller 44 when the switching guide 38 is disposed at the straight path guide position 72 is smaller than that of the switching guide 141 of the image reading apparatus of the fifth comparative example (see FIG. 8). Therefore, the image reading apparatus 1 of the first embodiment can reduce a notch formed in the switching guide 38 as compared to the switching guide 141 of the image reading apparatus of the fifth comparative example, and therefore can appropriately guide a document to the U-turn conveying path 67.

Effects of Image Reading Apparatus

The image reading apparatus 1 of the first embodiment includes the reading device 32, the switching guide 38, and the fourth conveying roller 44. The reading device 32 reads an image on a document that is conveyed between the conveying path and the conveying path 66. The switching guide 38 is supported so as to be able to rotate about the rotation axis 73, guides the document to the U-turn conveying path 67 by being disposed at the U-turn path guide position 71, and guides the document to the straight conveying path 68 by being disposed at the straight path guide position 72. After the reading device 32 reads the document, the fourth conveying roller 44 conveys the document to the U-turn conveying path 67 or the straight conveying path 68. The U-turn conveying path 67 is arranged above the plane 74 that is formed along a space between the conveying path 65 and the conveying path 66. At this time, the rotation axis 73 is arranged so as to overlap the fourth conveying roller 44. In other words, the rotation axis 73 is arranged below the plane 74 and on the rear side relative to the vertical plane 75 that comes in contact with the front edge of the fourth conveying roller 44. The rotation axis 73 is arranged such that a distance from the plane 74 to the rotation axis 73 becomes smaller than a length that is four times as large as the diameter of the fourth conveying roller 44. The rotation axis 73 is arranged on the front side relative to another vertical plane that comes in contact with the rear edge of the fourth conveying roller 44.

Due to the arrangement of the rotation axis 73 as described above, the image reading apparatus 1 of the first embodiment can reduce an amount that the switching guide 38 protrudes to the front side from the vertical plane 75 when the switching guide 38 moves between the U-turn path guide position 71 and the straight path guide position 72. By reducing the amount of protrusion from the vertical plane 75, the image reading apparatus 1 can reduce the setting space. Further, in the image reading apparatus 1, the switching guide 38 is arranged below the plane 74 when the switching guide 38 is disposed at the straight path guide position 72, so that it is possible to improve the visibility of a document that is discharged via the straight conveying path 68. Furthermore, in the image reading apparatus 1, the switching guide 38 is arranged on the rear side relative to the vertical plane 75 when the switching guide 38 is disposed at the straight path guide position 72, so that it is possible to appropriately discharge a document while preventing the document that is discharged via the straight conveying path 68 from coming in contact with the switching guide 38.

Second Embodiment

Figure 19:
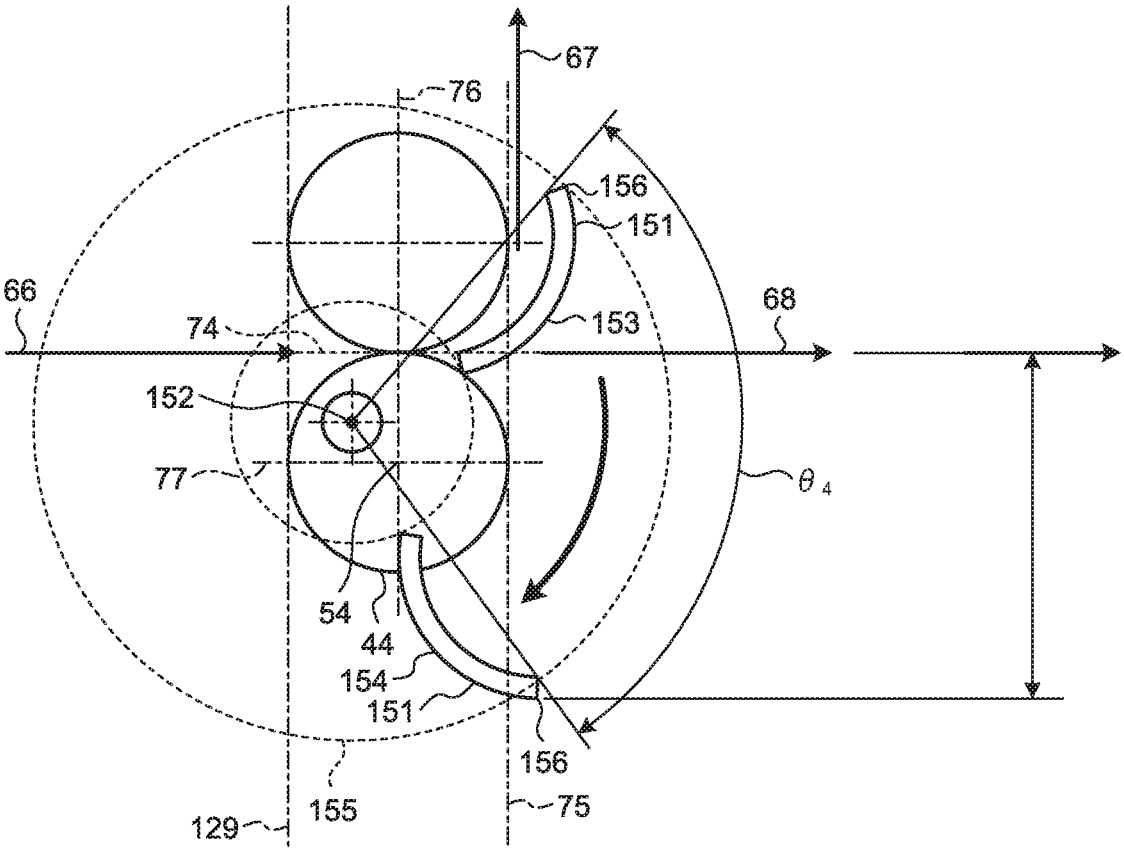
FIG. 19 is a schematic cross-sectional view illustrating a switching guide of an image reading apparatus according to a second embodiment.

FIG. 19 illustrates a switching guide 151 of an image reading apparatus according to a second embodiment. As illustrated in FIG. 19, the image reading apparatus of the second embodiment includes the switching guide 151 instead of the switching guide 38 of the image reading apparatus 1 of the first embodiment described above. The switching guide 151 is supported by the frame 20 so as to be able to rotate about a rotation axis 152. The rotation axis 152 is arranged below the plane 74. Further, the rotation axis 152 is arranged on the front side relative to the vertical plane 129 that comes in contact with the rear edge of the fourth conveying roller 44 among vertical planes that are parallel to the rotation axis 54, and arranged on the rear side relative to the vertical plane 76. Furthermore, the rotation axis 152 is arranged so as to cross the fourth conveying roller 44.

The switching guide 151 can be disposed at a U-turn path guide position 153 and a straight path guide position 154 by rotating about the rotation axis 152. In other words, the switching guide 151 moves to the straight path guide position 154 by normally rotating (clockwise in FIG. 19) by an angle θ4 about the rotation axis 152 from the U-turn path guide position 153. The switching guide 151 moves to the U-turn path guide position 153 by reversely rotating (counterclockwise in FIG. 19) by the angle θ4 about the rotation axis 152 from the straight path guide position 154. When disposed at the U-turn path guide position 153, the switching guide 151 guides a document that has been conveyed through the conveying path 66 to the U-turn conveying path 67. When disposed at the straight path guide position 154, the switching guide 151 guides a document that has been conveyed through the conveying path 66 to the straight conveying path 68.

In the image reading apparatus of the second embodiment, similarly to the image reading apparatus 1 of the first embodiment as described above, the switching guide 38 is arranged below the plane 74 when the switching guide 38 is disposed at the straight path guide position 72, so that it is possible to improve the visibility of a document that is discharged via the straight conveying path 68. Further, in the image reading apparatus of the second embodiment, the switching guide 151 is arranged on the rear side relative to the vertical plane 75 when the switching guide 151 is disposed at the straight path guide position 154, so that it is possible to appropriately discharge a document that has been conveyed through the straight conveying path 68 while preventing the document from coming in contact with the switching guide 151.

Effects of Image Reading Apparatus of Second Embodiment

The rotation axis 152 of the image reading apparatus of the second embodiment is arranged on the rear side relative to the vertical plane 76 that includes the rotation axis 54 of the fourth conveying roller 44 and arranged above the plane 77 that includes the rotation axis 54. The switching guide 151 moves between the U-turn path guide position 153 and the straight path guide position 154 such that an end 156 of the switching guide 151 on the far side from the rotation axis 152 moves along a trajectory 155. The trajectory 155 indicates that a portion of the switching guide 151 that protrudes to the front side from the vertical plane 75 when the switching guide 151 rotates is smaller than that of the switching guide 38 of the image reading apparatus 1 of the first embodiment described above. Therefore, the image reading apparatus of the second embodiment can further reduce a setting space as compared to the image reading apparatus 1 of the first embodiment described above.

Meanwhile, the rotation axis 73 of the image reading apparatus 1 of the first embodiment and the rotation axis 152 of the image reading apparatus of the second embodiment are arranged so as to cross the fourth conveying roller 44, but may be arranged so as not to cross the fourth conveying roller 44.

Third Embodiment

Figure 20:
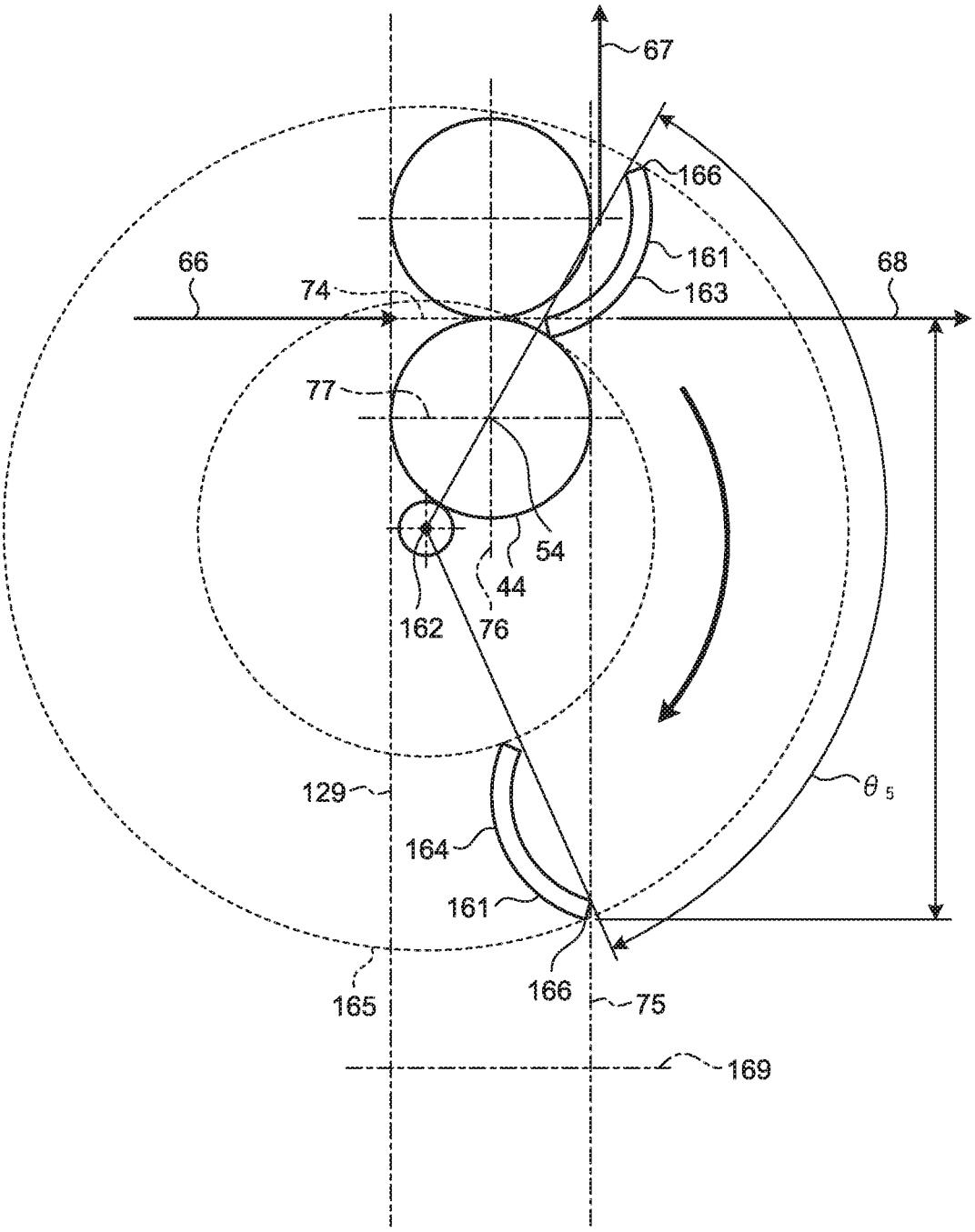
FIG. 20 is a schematic cross-sectional view illustrating a switching guide of an image reading apparatus according to a third embodiment.

FIG. 20 illustrates a switching guide 161 of an image reading apparatus according to a third embodiment. As illustrated in FIG. 20, the image reading apparatus of the third embodiment includes the switching guide 161 instead of the switching guide 38 of the image reading apparatus 1 of the first embodiment described above. The switching guide 161 is supported by the frame 20 so as to be able to rotate about a rotation axis 162. The rotation axis 162 is arranged below the plane 74. Further, the rotation axis 162 is arranged on the front side relative to the vertical plane 129 that comes in contact with the rear edge of the fourth conveying roller 44 among vertical planes that are parallel to the rotation axis 54, and arranged on the rear side relative to the vertical plane 76. Further, the rotation axis 162 is arranged above a plane 169 that is parallel to the plane 74. The plane 169 is arranged such that a distance between the plane 169 and the plane 74 becomes smaller than a length that is four times as large as the diameter of the fourth conveying roller 44. Furthermore, the rotation axis 162 is arranged so as not to cross the fourth conveying roller 44.

The switching guide 161 can be disposed at a U-turn path guide position 163 and a straight path guide position 164 by rotating about the rotation axis 162. In other words, the switching guide 161 moves to the straight path guide position 164 by normally rotating (clockwise in FIG. 20) by an angle 65 about the rotation axis 162 from the U-turn path guide position 163. The switching guide 161 moves to the U-turn path guide position 163 by reversely rotating (counterclockwise in FIG. 20) by the angle 65 about the rotation axis 162 from the straight path guide position 164. When disposed at the U-turn path guide position 163, the switching guide 161 guides a document that has been conveyed through the conveying path 66 to the U-turn conveying path 67. When disposed at the straight path guide position 164, the switching guide 161 guides a document that has been conveyed through the conveying path 66 to the straight conveying path 68.

In the image reading apparatus of the third embodiment, similarly to the image reading apparatus 1 of the first embodiment as described above, the switching guide 38 is arranged below the plane 74 when the switching guide 38 is disposed at the straight path guide position 72, so that it is possible to improve the visibility of a document that is discharged via the straight conveying path 68. Further, in the image reading apparatus of the third embodiment, the switching guide 161 is arranged on the rear side relative to the vertical plane 75 when the switching guide 161 is disposed at the straight path guide position 164, so that it is possible to appropriately discharge a document that has been conveyed through the straight conveying path 68 while preventing the document from coming in contact with the switching guide 161.

The switching guide 161 moves between the U-turn path guide position 163 and the straight path guide position 164 such that an end 166 of the switching guide 161 on the far side from the rotation axis 162 moves along a trajectory 165. The trajectory 165 indicates that a portion of the switching guide 161 that protrudes to the front side from the vertical plane 75 when the switching guide 161 rotates is smaller than that of the switching guide 38 of the image reading apparatus 1 of the first embodiment described above. Therefore, the image reading apparatus of the third embodiment can further reduce the setting space as compared to the image reading apparatus 1 of the first embodiment as described above.

The angle θ5 is smaller than the angle θ1 by which the switching guide 38 of the image reading apparatus 1 of the first embodiment described above rotates. In the image reading apparatus of the third embodiment, because the angle θ5 is small, it is possible to move the switching guide 161 between the U-turn path guide position 163 and the straight path guide position 164 in a short time as compared to the image reading apparatus 1 of the first embodiment described above. By moving the switching guide 161 in a short time, the image reading apparatus of the third embodiment can reduce the risk that the switching guide 161 comes in contact with a document while the switching guide 161 is moving, so that it is possible to reduce the risk that the document is sandwiched between the switching guide 161 and the fifth conveying guide 37.

Effects of Image Reading Apparatus of Third Embodiment

The rotation axis 162 of the image reading apparatus of the third embodiment is arranged so as not to overlap the fourth conveying roller 44. Therefore, it is not necessary to form a notch in a certain region of the switching guide 161 that comes in contact with a document, in order to prevent interference with the fourth conveying roller 44. Because the notch is not formed, it is possible to increase the strength of the switching guide 161 as compared to the switching guide 38 of the image reading apparatus 1 of the first embodiment and the switching guide 151 of the image reading apparatus of the second embodiment. Further, in the image reading apparatus of the third embodiment, the rotation axis 162 is arranged above the plane 169, so that the end 166 of the switching guide 161 is not separated from the plane 74 by a predetermined distance or larger when the switching guide 161 is disposed at the straight path guide position 164. In the image reading apparatus of the third embodiment, the end 166 of the switching guide 161 is not separated by the predetermined distance or larger from the plane 74, so that it is not necessary to separate the plane 74 from the setting surface by the predetermined distance or larger, and it is possible to reduce the size of the apparatus.

Meanwhile, the rotation axis 162 is arranged such that the distance to the plane 74 becomes smaller than the length that is four times as large as the diameter of the fourth conveying roller 44, but may be separated by this length or larger. In the image reading apparatus of the third embodiment, even when the rotation axis 162 is separated from the plane 74, the rotation axis 162 does not overlap the fourth conveying roller 44, so that it is possible to increase the strength of the switching guide 161.

Meanwhile, the rotation axes of the switching guides of the image reading apparatuses of the first to the third embodiments are arranged on the front side relative to the vertical plane 129, but may be arranged on the rear side relative to the vertical plane 129. In the image reading apparatuses of the first to the third embodiments, even when the rotation axes of the switching guides are arranged on the front side relative to the vertical plane 129, the rotation axes of the switching guides are arranged below the plane 74 and arranged on the rear side relative to the vertical plane 75, so that it is possible to reduce the sizes of the apparatuses.

Furthermore, in the image reading apparatus 1 of the embodiment, the reading device 32 includes the lower image sensor 61 and the upper image sensor 62, but it may be possible to replace one of the lower image sensor 61 and the upper image sensor 62 with a conveying guide. An image reading apparatus in which one of the lower image sensor 61 and the upper image sensor 62 is replaced with the conveying guide reads only one side of a document to be conveyed. Even in the image reading apparatus as described above, the rotation axis of the switching guide is arranged below the plane 74 and arranged on the rear side relative to the vertical plane 75, so that it is possible to reduce the size of the apparatus.

Meanwhile, the conveying path 65, the conveying path 66, and the straight conveying path 68 are formed along a plane that is parallel to the setting surface of the image reading apparatus, but may be formed along a plane that is inclined with respect to the setting surface. Examples of the inclined plane include a plane that is inclined such that the front side is located lower than the rear side, and a surface that is inclined by 15 degrees with respect to the setting surface of the image reading apparatus. Even when the image reading apparatus is configured as described above, the rotation axis of the switching guide is arranged below the plane 74 and arranged on the rear side relative to the vertical plane 75, so that it is possible to reduce the size of the apparatus.

An image reading apparatus disclosed herein can be downsized.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the disclosure have been described in detail, it should be understood that the various changes, substitutions, and alterations could be made hereto without departing from the spirit and scope of the disclosure.

What is claimed is:

1. An image reading apparatus comprising:

a reading device that reads an image on a document conveyed through a first conveying path;

a switching guide that is supported so as to be able to rotate about a rotation axis, guides the document to a second conveying path by being disposed at a first position, and guides the document to a third conveying path by being disposed at a second position; and a roller that conveys the document to one of the second conveying path and the third conveying path after the reading device reads the document, wherein the second conveying path is arranged above a plane formed along the first conveying path, the rotation axis is arranged below the plane and on an upstream side of a vertical plane that comes in contact with an edge of a downstream side of the roller, the rotation axis is arranged on a downstream side of another vertical plane that comes in contact with an edge of the upstream side of the roller, and the rotation axis is arranged on an upstream side of still another vertical plane that includes a different rotation axis about which the roller rotates and arranged above a horizontal plane that includes the different rotation axis.

2. The image reading apparatus according to claim 1, wherein the rotation axis is arranged so as not to overlap the roller.

3. The image reading apparatus according to claim 1, wherein the rotation axis is arranged so as to overlap the roller.

4. An image reading apparatus comprising:

a reading device that reads an image on a document conveyed through a first conveying path;

a switching guide that is supported so as to be able to rotate about a rotation axis, guides the document to a second conveying path by being disposed at a first position, and guides the document to a third conveying path by being disposed at a second position; and a roller that conveys the document to one of the second conveying path and the third conveying path after the reading device reads the document, wherein the second conveying path is arranged above a plane formed along the first conveying path, the rotation axis is arranged below the plane and on an upstream side of a vertical plane that comes in contact with an edge of a downstream side of the roller, the rotation axis is arranged on a downstream side of another vertical plane that comes in contact with an edge of the upstream side of the roller, the rotation axis is arranged such that a distance between the plane and the rotation axis is smaller than a length that is four times as large as a diameter of the roller, and the rotation axis is arranged so as not to overlap the roller.

5. An image reading apparatus comprising:

a reading device that reads an image on a document when the document is conveyed from a first conveying path to a second conveying path arranged downstream of the first conveying path;

two rollers that sandwich the document when the document is conveyed through the second conveying path; and a switching guide that is supported so as to be able to rotate about a rotation axis, guides the document to a third conveying path by being disposed at a first position when the document is conveyed downstream of the second conveying path by the two rollers, and guides the document to a fourth conveying path by being disposed at a second position, wherein the third conveying path is arranged above a plane formed along the second conveying path, and the rotation axis is arranged below the plane and on an upstream side of a vertical plane that comes in contact with an edge of a downstream side of one of the two rollers, the one of the two rollers being arranged below the second conveying path.

6. The image reading apparatus according to claim 5, wherein the rotation axis is arranged on a downstream side of another vertical plane that comes in contact with an edge of the upstream side of the one of the two rollers.

7. The image reading apparatus according to claim 6, wherein the rotation axis is arranged such that a distance between the plane and the rotation axis is smaller than a length that is four times as large as a diameter of the one of the two rollers.

8. The image reading apparatus according to claim 7, wherein the rotation axis is arranged so as not to overlap the one of the two rollers.

9. The image reading apparatus according to claim 6, wherein the rotation axis is arranged on an upstream side of still another vertical plane that includes a different rotation axis about which the one of the two rollers rotates and arranged above a horizontal plane that includes the different rotation axis.

10. The image reading apparatus according to claim 5, wherein the rotation axis is arranged so as to overlap the one of the two rollers.

* * * * *